US011359582B1

(12) United States Patent
Dudar

(10) Patent No.: US 11,359,582 B1
(45) Date of Patent: Jun. 14, 2022

(54) SYSTEMS AND METHODS FOR CANISTER FILTER DIAGNOSTICS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/443,090

(22) Filed: Jul. 20, 2021

(51) Int. Cl.
*F02M 25/08* (2006.01)

(52) U.S. Cl.
CPC .... *F02M 25/0818* (2013.01); *F02M 25/0836* (2013.01); *F02M 25/0854* (2013.01)

(58) Field of Classification Search
CPC ..... F02M 25/0818; F02M 25/0836; F02M 25/0854
See application file for complete search history.

(56) References Cited

U.S. PATENT DOCUMENTS

| | | | | |
|---|---|---|---|---|
| 6,931,919 | B2 | 8/2005 | Weldon | |
| 7,284,530 | B2 | 10/2007 | Nagasaki et al. | |
| 8,056,397 | B2 | 11/2011 | Herzog et al. | |
| 9,243,592 | B2 | 1/2016 | Dudar et al. | |
| 9,599,071 | B2 | 3/2017 | Dudar | |
| 2017/0008390 | A1* | 1/2017 | Dudar | F02D 41/003 |
| 2019/0368431 | A1 | 12/2019 | Dudar | |

* cited by examiner

*Primary Examiner* — Xiao En Mo
(74) *Attorney, Agent, or Firm* — Geoffrey Brumbaugh

(57) ABSTRACT

Methods and systems are provided for diagnosing a restriction of a fuel vapor canister. In one example, a method may include diagnosing restriction of a canister filter responsive to a first rate of decay of pressure of the canister to a target pressure being less than a first threshold rate of decay, when evacuating the canister to the atmosphere, and a second rate of decay of a pressure of the evaporative emissions control system to a target pressure being greater than a second threshold rate of decay, when evacuating the canister to a fuel tank.

20 Claims, 16 Drawing Sheets

SYSTEMS AND METHODS FOR CANISTER FILTER DIAGNOSTICS

FIELD

The present description relates generally to methods and systems for diagnosing a canister filter integrated within a fuel vapor canister.

BACKGROUND/SUMMARY

Vehicles may be fitted with evaporative emission control systems to reduce the release of fuel vapors to the atmosphere. For example, evaporative emissions control systems may include a carbon canister coupled to a fuel tank for adsorbing refueling, diurnal and running loss hydrocarbon vapors from the fuel tank during engine-off conditions. At a later time when the engine is in operation, a canister purge valve positioned within a purge line coupling the canister and the engine intake manifold is opened, which allows the vapors to be purged into the engine intake manifold for use as fuel.

Activated carbon inside a canister bed of the canister is used to adsorb the vaporized hydrocarbons. The carbon is comprised of pellets that have microscopic pores to trap the hydrocarbons. Over time, carbon dust breaks away from the pellets and migrates to the purge valve. Consequently, leaks may occur in the purge valve. Leaky purge valves are expensive to replace and may degrade the fuel tank.

In order to mitigate carbon dust migration from the canister to the purge valve, a canister filter may be employed within the canister near a purge port to trap the carbon dust and therefore prevent the carbon dust from clogging the purge valve. However, the canister filter may become restricted over a period of time. For example, activated carbon breakdown due to liquid fuel entering the canister may cause the canister to clog. When the canister filter is restricted, the engine vacuum may not be able to reach the canister, thereby hampering purging operations. The inability to purge causes the canister to saturate, which leads to increased hydrocarbon breakthrough to the atmosphere, and hence increased evaporative emissions. Further, evaporative emissions leak diagnostics that use engine vacuum to evacuate fuel vapors from a fuel tank and perform bleed up analysis may be affected due to the clogged carbon filter. For example, the blocked carbon filter may impede communication of engine vacuum to the fuel tank. Still further, in hybrid vehicles, a restricted canister filter may impede fuel tank depressurization prior to a refueling sequence.

An example of a method for diagnosing a restricted canister filter is described by Dudar in U.S. Pat. No. 9,599,071. Therein, the canister filter restriction is identified based on a duration to reduce a pressure in an evaporative emissions control system, which includes reduction of the canister pressure to a reference pressure as well as an initial pressure difference across the canister upon opening a canister purge valve when the evaporative emissions control system is at the reference pressure. However, the method does not enable differentiation between restriction at the canister bed versus restriction due to the canister filter. Furthermore, the method does not include automatic execution of actions to address the restricted canister filter.

The inventors herein have recognized the above issues, and have developed systems and methods to at least partially address them. In one example, a method for diagnosing a carbon canister is provided. The method includes indicating restriction of an integrated filter of a fuel vapor canister responsive to, during evacuation of the canister to atmosphere, a first rate of decay of a pressure of an evaporative emissions control system to a first target pressure being less than a first threshold rate of decay, and during evacuation of the canister to a fuel tank, a second rate of decay of the pressure of the evaporative emissions control system to a second target pressure being greater than a second threshold rate of decay.

As an example, during engine-off conditions, an evaporative leak check module (ELCM) pump disposed in a vent line between the canister and atmosphere may be operated to evacuate a portion of the evaporative emissions control system with the purge valve and a fuel tank isolation valve (FTIV) closed (also referred to herein as canister side of the evaporative emissions control system). In one example, upon opening the purge valve after the canister has been evacuated, the canister vacuum vents to the atmosphere, with air flowing from the atmosphere through a purge port of the canister via a purge line between the purge valve and the purge port. As the canister filter is positioned such that air flow through the purge valve flows through the canister filter, if the canister filter is restricted, the first rate of decay of the pressure of the canister decreases compared to a rate of pressure decay for the canister with an unrestricted canister filter. Additionally, the first rate of decay may be reduced by restriction of the canister bed, as air flow during venting to the atmosphere also flows over the canister bed. Therefore, restriction of the canister may be diagnosed based on the first rate of decay when evacuating the canister to the atmosphere, where, when the first rate of decay is less than the first threshold decay, the method diagnoses a restriction.

Additionally, a diagnosis may be made to determine which element of the canister, which may include the canister filter and the canister bed, or the FTIV, is causing the restriction based on the second threshold rate of decay of the pressure of the evaporative emissions control system to a target pressure when evacuating the canister to the fuel tank and the first threshold rate of decay. In an evacuated canister side, upon opening the FTIV, the canister vacuum vents to the fuel tank via a conduit between the FTIV and a load port of the canister. As the canister is positioned such that air flows through the FTIV does not flow through the canister filter, the second rate of decay of the pressure of the canister may not be affected by the restricted canister filter. Restriction of the canister filter may be diagnosed based on the second rate of decay being greater than the second threshold rate of decay and the first rate of decay being less than the first threshold rate of decay. Restriction of the canister bed may be diagnosed based on the second rate of decay being less than the second threshold rate of decay and the first rate of decay being less than the first threshold rate of decay. Restriction of the FTIV may be diagnosed based on the second rate of decay being less than the second threshold rate of decay and the first rate of decay being greater than the first threshold rate of decay. If the second rate of decay is greater than the second threshold rate of decay and the first rate of decay is greater than the first threshold rate of decay, then the FTIV and both the canister bed and the canister filter may be unrestricted. If a restricted canister bed or restricted FTIV is diagnosed, a vehicle operator may be alerted of a degraded canister filter condition and prompted to take corrective actions (such as replacing the canister or FTIV), thus saving on warranty and/or repair costs.

If the canister filter is restricted, a degree of restriction (partial or full restriction) may be determined, and a remaining filter lifetime may be estimated using the ELCM. Further, when the canister filter is diagnosed as fully restricted, the canister filter may be regenerated by operating the ELCM pump to pull a vacuum across the canister filter to dislodge contaminants restricting the canister filter.

In this way, an existing ELCM pump that is utilized for evaporative emissions leak detection routines is also utilized to diagnose a canister filter. By diagnosing restriction of the canister, diagnosing a restriction source, and regenerating a restricted canister filter, an onboard system (e.g., the ELCM) is used to diagnose and take corrective action based on the diagnosis of the canister filter, which may prolong a canister filter lifetime and save on warranty and/or repair costs. Further, if canister filter restriction is diagnosed, evaporative emissions leak diagnostics may not be performed until corrective actions are taken, thereby reducing degradation of evaporative emissions leak diagnostics due to clogged canister filter. Still further, by diagnosing canister filter restriction, and taking corrective actions based on the diagnosis, purging efficiency may be maintained at a desired level. Consequently, emissions may be reduced and fuel economy may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 13:
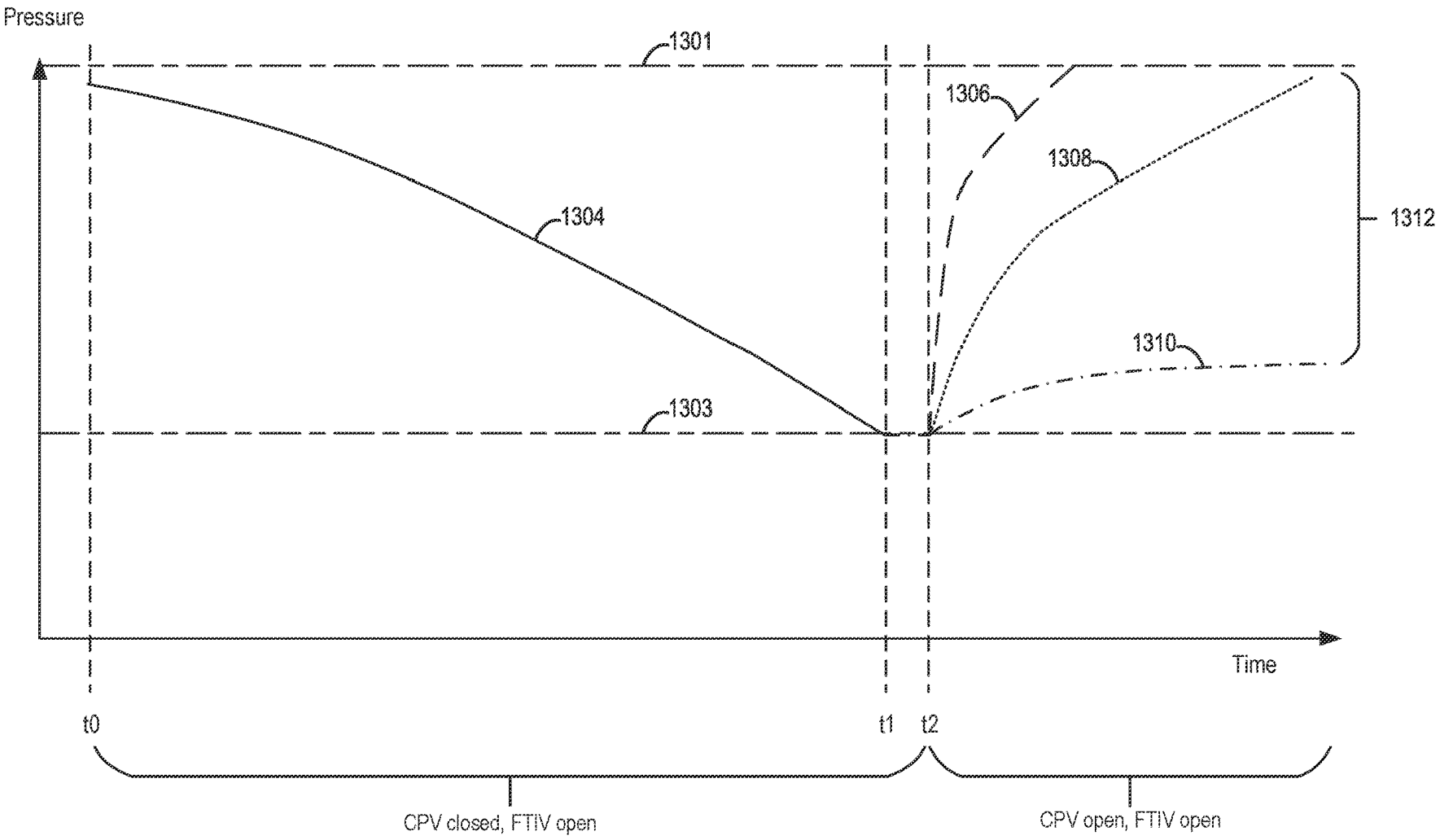
FIG. 13 shows a graph illustrating an example canister filter diagnostic cycle.
Figure 14:
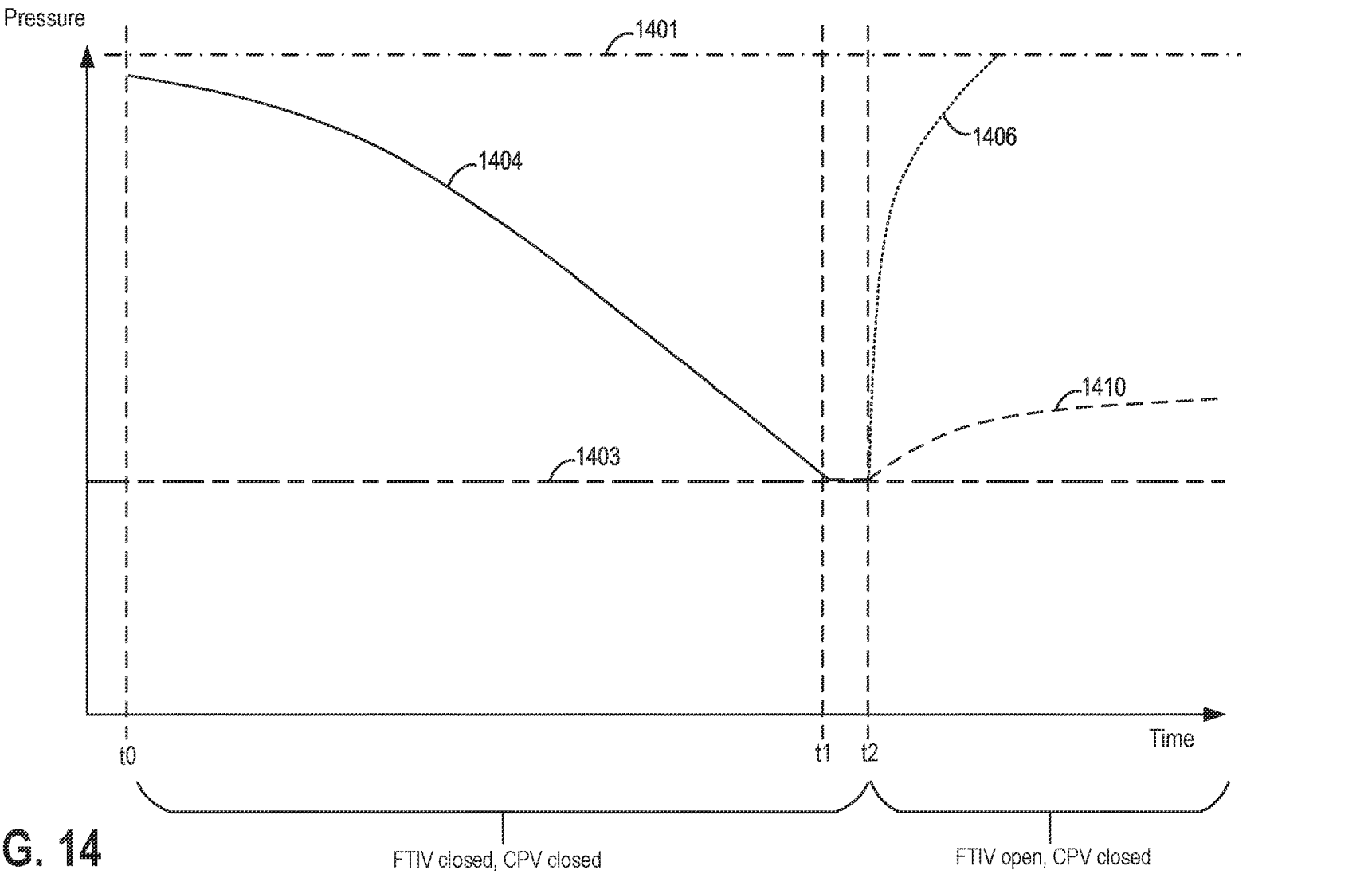
FIG. 14 shows a graph illustrating an example canister bed and canister filter diagnostic cycle.
Figure 15:
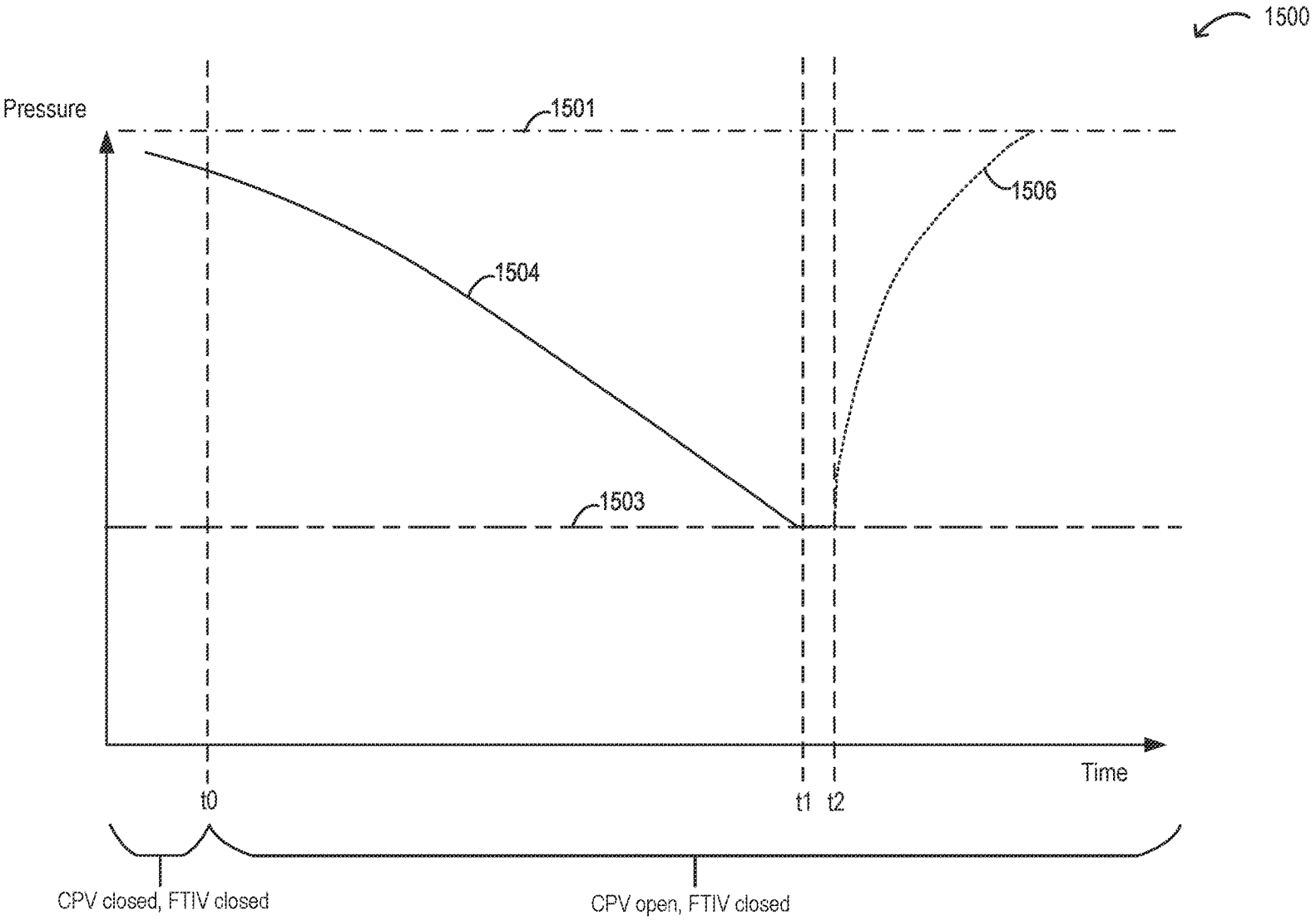
FIG. 15 shows a graph illustrating an example canister filter regeneration cycle.

The following description relates to systems and methods for diagnosing a canister filter integrated within a fuel vapor canister. Specifically, this description relates to systems and methods for diagnosing a canister filter within a fuel vapor canister during an engine-off condition. The fuel vapor canister may be included in a plug-in hybrid vehicle (PHEV), such as the PHEV schematically depicted in FIG. 1. The fuel vapor canister may be included in an evaporative emissions system coupled to a fuel system, as shown schematically in FIG. 2. The evaporative emissions system may include an evaporative leak check module (ELCM), operable in multiple conformations, as shown schematically in FIGS. 3, 4, and 6. An example ELCM operating cycle is shown in the graph of FIG. 5. The ELCM may be utilized to diagnose a canister filter and regenerate a restricted canister filter. An example canister filter is schematically shown in FIG. 7. During certain engine-off conditions, a controller, such as controller 212 at FIG. 2 may be configured to perform control routines according to the methods of FIGS. 8-12 to diagnose restriction of a canister filter, to diagnose a degree of restriction of the canister filter, to estimate a remaining lifetime of the canister filter, diagnose restriction of a canister bed, and regenerate a restricted canister filter respectively. Example graphs of a filter diagnostic cycle, a canister bed and canister filter diagnostic cycle, and a filter regeneration cycle are shown in FIGS. 13-15 respectively.

Figure 1:
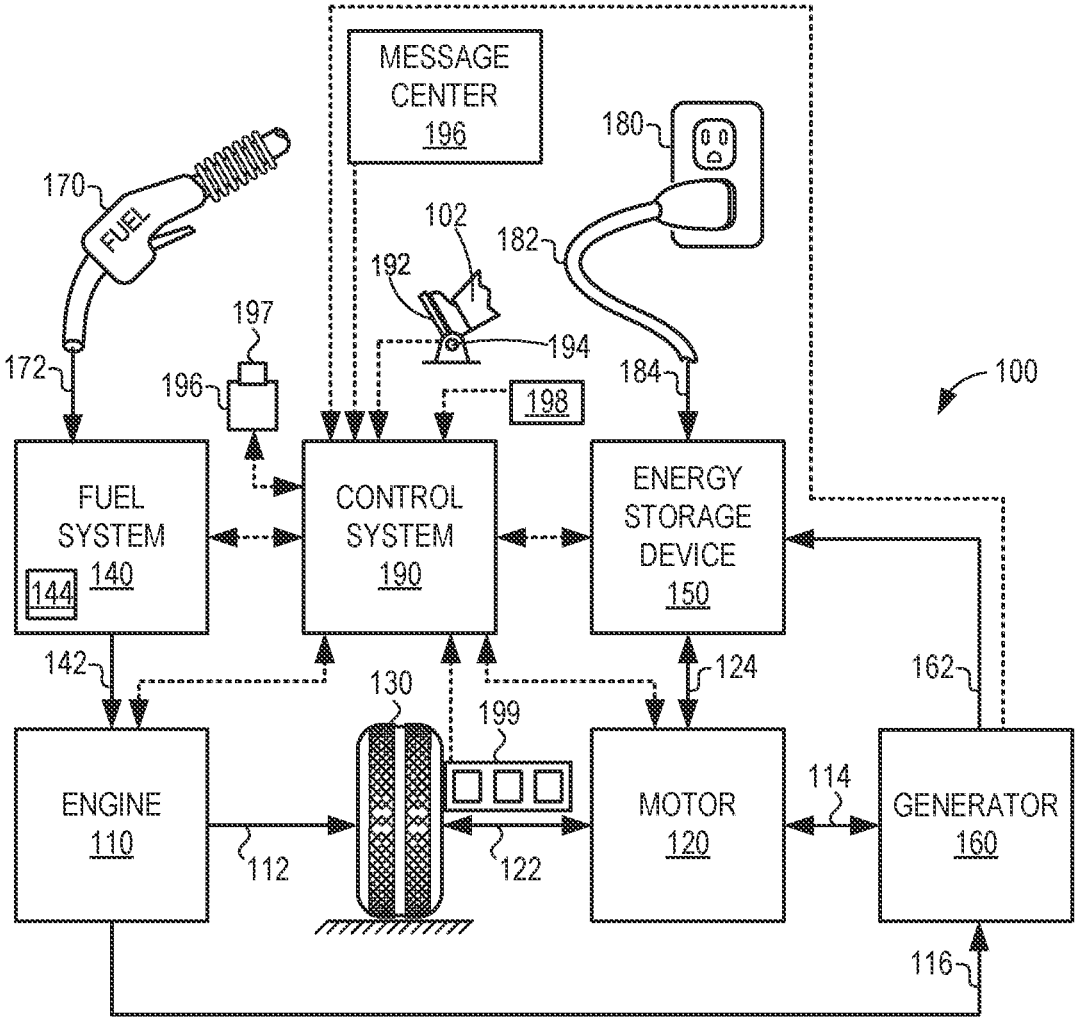
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIGS. 8-12, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed. In one example, vehicle instrument panel 196 may indicate a restriction of a canister filter integrated within a fuel vapor canister coupled to the fuel tank. The indication of the restriction may be based on a diagnosis of the canister filter during an engine-off condition and may include an indication of partial or full restriction of the canister filter, and may further include an estimate of a remaining lifetime of the canister filter. In one example, vehicle instrument panel 196 may further include an indication of a canister bed restriction or an indication of a restricted fuel tank isolation valve. Details of diagnosing a canister filter will be further elaborated herein with respect to FIGS. 8-12.

Figure 2:
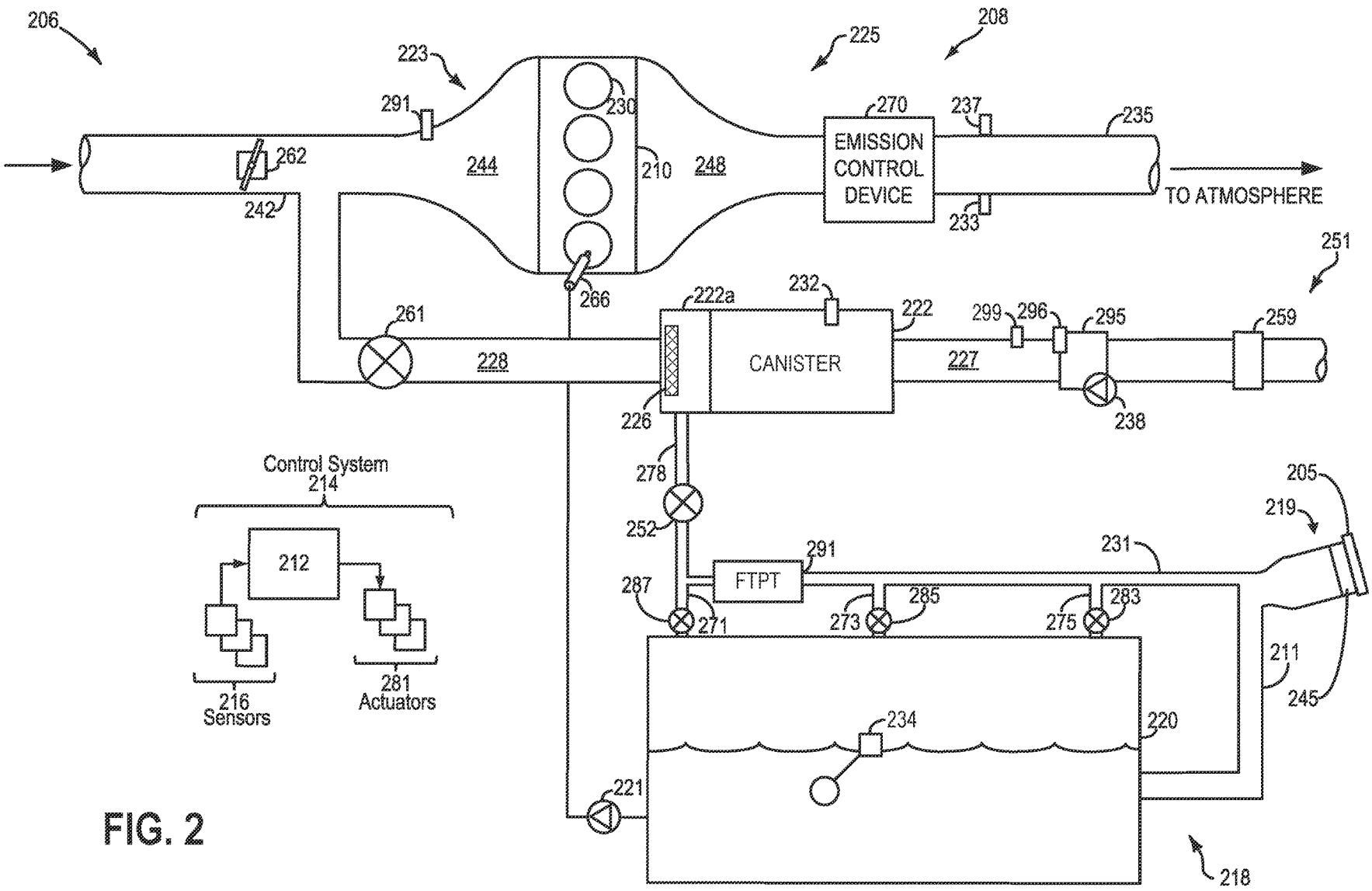
FIG. 2 schematically shows an example vehicle system with a fuel system and an evaporative emissions system.

FIG. 2 shows a schematic depiction of a vehicle system 206. The vehicle system 206 includes an engine system 208 coupled to an emissions control system 251 and a fuel system 218. The engine system 208 may include the engine 110 of FIG. 1, and the fuel system 218 may be the fuel system 140 of FIG. 1, in one example. Emissions control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves are positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a refueling system 219. In some examples, the refueling system may include a fuel cap 205 for sealing off the refueling system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, where the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer **222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222**.

Canister 222 may include a canister filter 226 integrated within the canister. Canister filter 226 may be disposed near a purge port that couples the canister with purge line 228. Canister filter may reduce migration of carbon dust (such as, carbon dust resulting from break down of carbon pellets that trap hydrocarbons) from canister 222 to purge line 228, and thus reduce clogging of purge valve 261 with carbon dust.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. During certain conditions, when the canister filter becomes restricted, vacuum from the intake manifold may not reach the canister, resulting in an inability to purge. Therefore, diagnosis of the canister filter may be performed as discussed in detail below to diagnose restriction of the canister filter, to estimate a remaining lifetime of the canister filter, and to regenerate the canister filter.

In some examples, vent line 227 may include an air filter 259 disposed therein upstream of a canister 222. In some examples, the air filter 259 may be a dust trap. In some examples, the flow of air and vapors between canister 222 and the atmosphere may be regulated by a canister vent valve coupled within vent line 227. For example, the canister vent valve may be coupled within vent line 227 at a location between an ELCM 295 and dust trap 259. When included, the canister vent valve may be a normally open valve, so that a fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), where the controller 212 may open FTIV 252 while closing canister purge valve (CPV) 261 to direct refueling vapors into canister 222 while preventing fuel vapors from being directed into the intake manifold.

As another example, the fuel system 218 may be operated in a refueling mode (e.g., when fuel tank refueling is requested by a vehicle operator), where the controller 212 may open FTIV 252, while maintaining canister purge valve 261 closed, to depressurize the fuel tank before allowing enabling fuel to be added therein. As such, FTIV 252 may be kept open during the refueling operation to allow refueling vapors to be stored in the canister. After refueling, the FTIV may be closed.

As yet another example, the fuel system may be operated in a canister purging mode (e.g., after an emission control device light-off temperature has been attained and with the engine running), wherein the controller 212 may open canister purge valve 261 while closing FTIV 252. Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Figure 3:
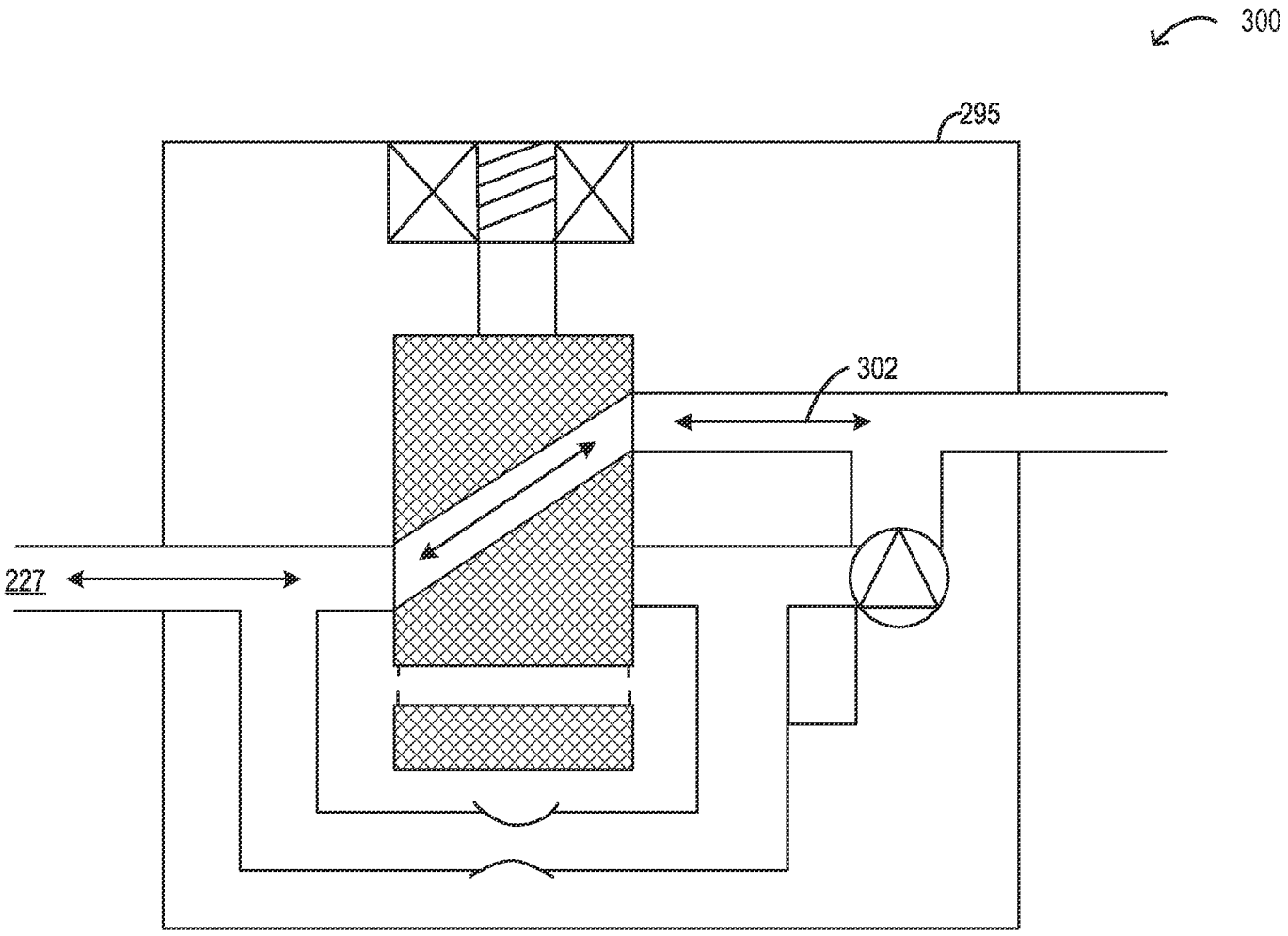
FIG. 3 schematically shows an example evaporative leak check module (ELCM) in a purging state.

An example of air flow during the canister purging mode through the ELCM 295 is shown in FIG. 3, with the ELCM 295 in first configuration 300. The ELCM 295 includes a changeover valve (COV) 402. The arrows 302 show air flow through the COV 402 and the vent 227. Further details of the ELCM will be described with reference to FIGS. 4 and 6.

Returning to FIG. 2, controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include a manifold absolute pressure (MAP) sensor 291, and an ELCM pressure sensor 296. Other sensors such as pressure, temperature, air/fuel ratio, and composition sensors may be coupled to various locations in the vehicle system 206. As another example, the actuators may include fuel injector 266, canister purge valve 261, throttle 262, fuel tank isolation valve 252, a pump within ELCM 295, vent valve (not shown), and refueling lock 245. The control system 214 may include a controller 212. The controller may receive input data from the various sensors, process the input data, and trigger the actuators in response to the processed input data based on instruction or code programmed therein corresponding to one or more routines. Example control routines are described herein with reference to FIGS. 8-12.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 295 communicatively coupled to controller 212. ELCM 295 may be positioned in vent 227, between canister 222 and the atmosphere. ELCM 295 may include a vacuum pump 238 for applying negative pressure to the fuel system when administering a leak test. For example, the vacuum pump 238 may be integrated into the ELCM 295 such that the ELCM 295 and the vacuum pump 238 form a monolithic unit. In some embodiments, vacuum pump 238 may be configured to be reversible. In other words, vacuum pump 238 may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed, as further described below. A hydrocarbon sensor 299 may be coupled at or near ELCM 295 within vent line 227.

In some embodiments, vacuum pump 238 included within ELCM 295 may be utilized to evacuate the evaporative emissions control system for diagnosing canister filter restriction, a degree of restriction, predicting a remaining lifetime of canister filter 226, and regenerating the restricted canister filter. For example, restriction of canister filter 226 may be diagnosed based on, after the canister has been evacuated by the pump to a target vacuum, a rate of decay of a pressure of a canister side of the evaporative emissions control system 251 to a target pressure when venting the canister side to the atmosphere or the fuel tank. Further, the pump may be operated in a reverse direction, that is, to pull air flow across the canister filter towards the dust trap, to regenerate the restricted canister filter, in one example. The canister side includes canister 222 and a portion of evaporative emissions control system 251 between CPV 261 and FTIV 252 when CPV 261 and FTIV 252 are closed. Further, a degree of restriction of canister filter 226 may be determined based on an initial pressure drop across the canister when the purge valve is opened upon reaching a reference pressure. Still further, an estimate of a remaining life of canister filter 226 may be determined based on a rate of vacuum decay and a duration for the evaporative emissions control system to stabilize to the atmospheric pressure from the reference pressure after opening CPV 261.

Figure 4:
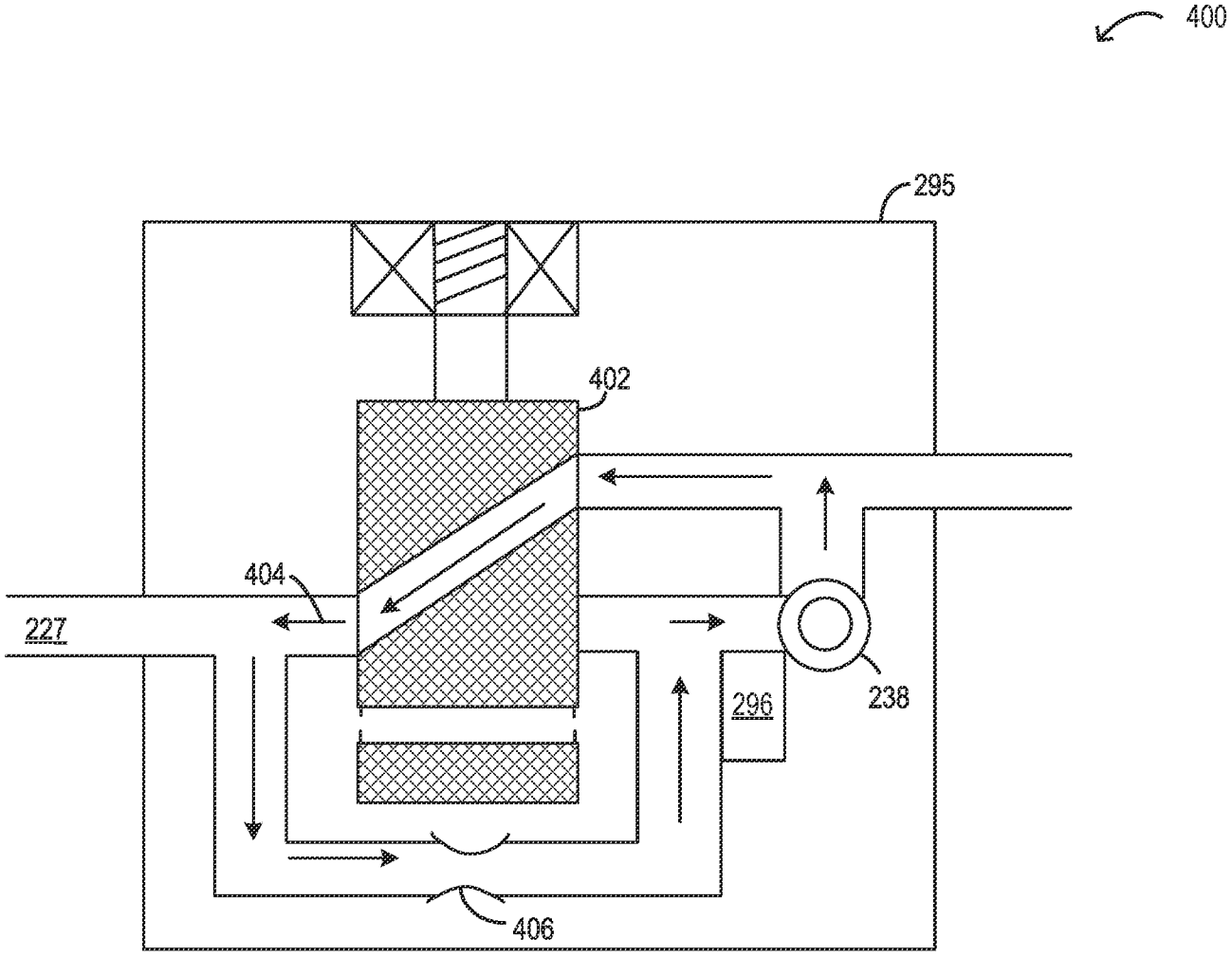
FIG. 4 schematically shows an example ELCM in a reference check state.
Figure 5:
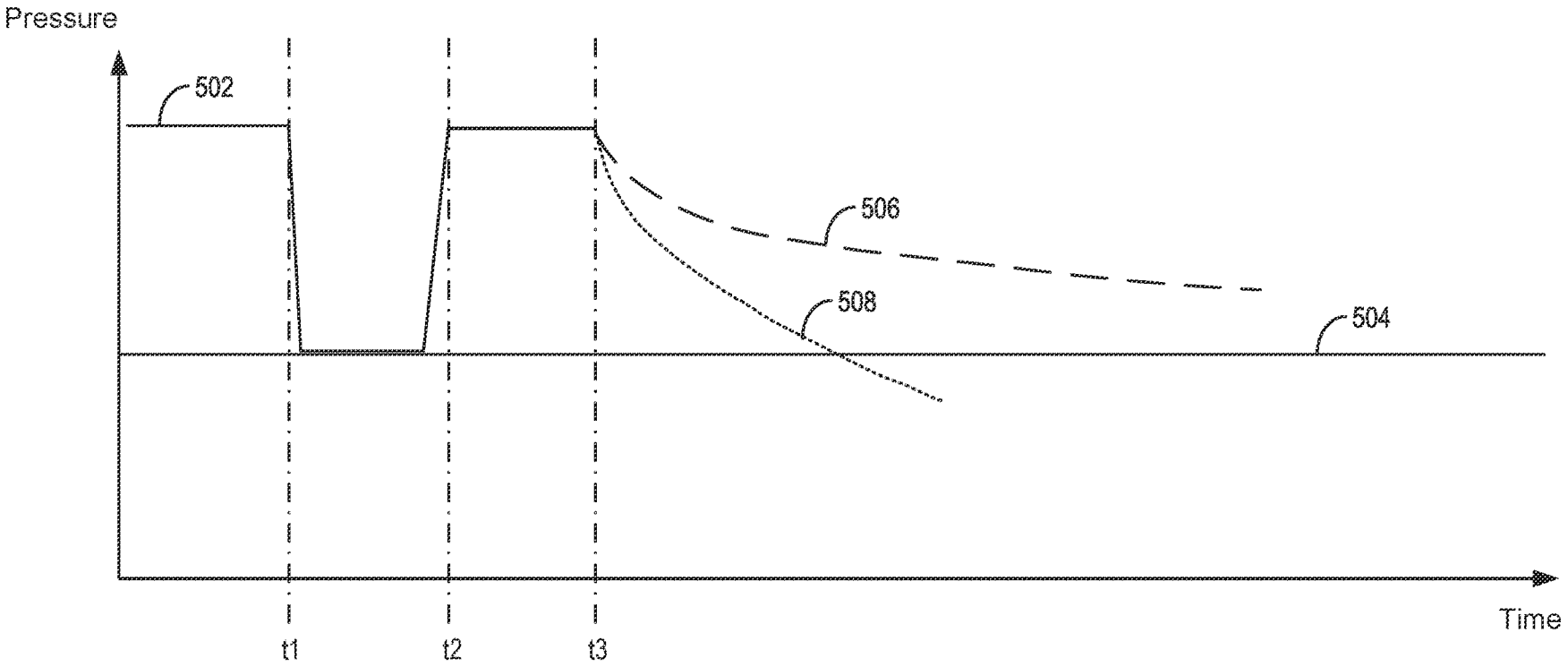
FIG. 5 shows a graph illustrating an example ELCM cycle.
Figure 6:
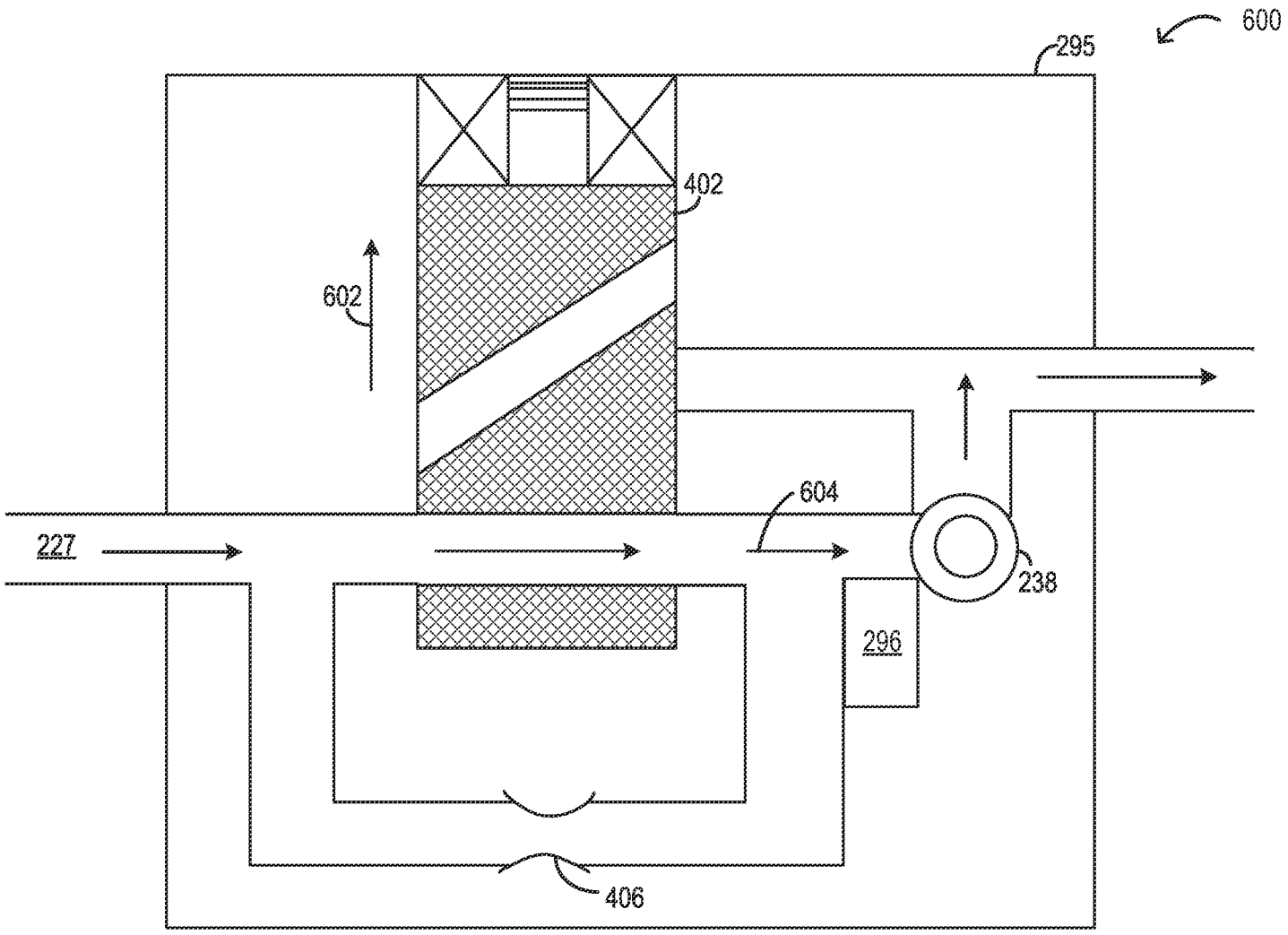
FIG. 6 schematically shows an example ELCM in a tank evacuation state.
Figure 7:
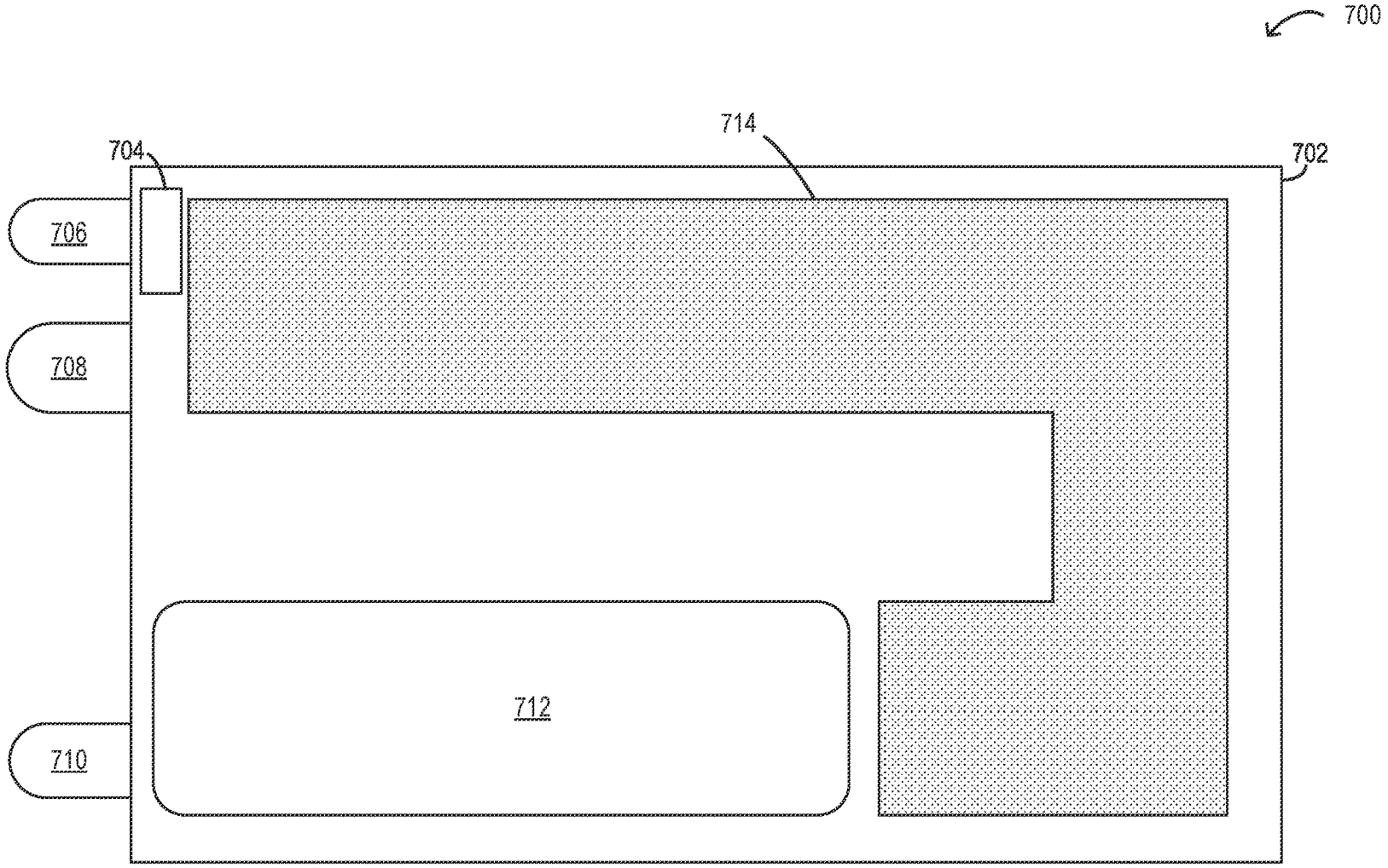
FIG. 7 schematically shows an example fuel vapor canister with an integrated canister filter.

As described above, ELCM 295 may further include the COV 402 (as shown in FIGS. 3, 4, and 6), in addition to pump 238, and pressure sensor 296. The COV 402 may be moveable between a first and a second position. FIG. 4 depicts ELCM 295 of FIG. 2 in a second configuration 400 where the COV 402 is in the first position, and pump 238 is activated in a first direction. Air flows through ELCM 295 in a first flow path, as represented by arrows 404. FIG. 6 depicts ELCM 295 of FIG. 2 in a third configuration 600 where COV 402 of FIG. 4 is in a second position, as shown by arrow 602, and pump 238 is activated in the first direction to evacuate the evaporative emissions control system, with air flow in a second direction indicated by arrows 604. The position of COV may be controlled by a solenoid via compression spring. Further, the reference orifice in the ELCM may have a diameter corresponding to the size of a threshold leak to be tested, for example, 0.02 inches. In either the first or second position, pressure sensor 296 may generate a pressure signal reflecting the pressure within ELCM 295. Operation of pump 238 and the solenoid may be controlled via signals received from controller 212.

During determination of the reference pressure, COV 402 is in the first position, and pump 238 is activated in the first direction, as shown in FIG. 4. Fuel tank isolation valve 252 is closed, isolating ELCM 295 from the fuel tank. In this configuration, pump 238 may draw a vacuum on reference orifice 406, and pressure sensor 296 may record the vacuum level within ELCM 295. This reference check vacuum level reading may then become the reference pressure for diagnosing the degree of canister filter restriction and a remaining lifetime of the canister filter. The reference check vacuum level may also be a threshold for passing/not passing a subsequent leak test. In other words, pump 238 may be operated for a duration to draw air from the emission control system through reference orifice 406 in order to obtain the reference pressure for canister filter diagnostics and for detecting leaks in the emission control system. The reference pressure may be modified to compensate for environmental conditions such as temperature, altitude, fuel level, etc.

FIG. 5 shows a graph 500 illustrating an example ELCM cycle, which may include determining a reference pressure and performing a leak test. The ELCM may be ELCM 295 of FIG. 2 with additional details as described in FIG. 4. The y-axis represents pressure of the ELCM, where the pressure sensor 296 may generate a pressure signal reflecting the pressure within ELCM 295. Vertical markers t1-t3 represent times of interest. The x-axis represents time, and time increases from the left side of the plot to the right side of the plot. Graph 500 includes plot 502 indicating a change in pressure of the ELCM through time during determination of the reference pressure. At t1, the COV is in the first position and the pump is activated in a first direction to draw a vacuum on the reference orifice. The reference pressure, as shown by the horizontal line of plot 502 between t1 and t2, may be used as the reference pressure for diagnosing the degree of canister filter restriction and a remaining lifetime of the canister filter, and may also be used as a threshold for passing/not passing a subsequent leak test, as shown by horizontal line 504. At t3, a leak detection routine may be performed, as described above. As shown in the third configuration 600 of the ELCM in FIG. 6, the COV is adjusted to the second position, as shown by arrow 602 and the pump 238 is activated to evacuate the evaporative emissions control system, with air flow indicated by arrows 604. Returning to FIG. 5, a first plot 506, representing a change in pressure at the reference orifice over time, does not cross the reference pressure threshold indicated by horizontal line 504. Thus, a leak in the fuel system is indicated by the first plot 506. A second plot 508, similarly representing a change in pressure at the reference orifice over time, does cross horizontal line 504. The second plot 508 therefore indicates no leak is present in the fuel system.

During diagnosis of canister restriction, the COV is in the second position, and pump 238 is activated in the first direction, as shown in FIG. 6. This configuration allows pump 238 to draw a vacuum on evaporative emissions control system 251. When diagnosing the canister filter, CPV 261 may be closed, and FTIV 252 may be closed to allow pump 238 to isolate canister 222 from fuel tank 220. In this configuration, the pump may be operated to draw air from emissions control system 251 through the pump and to the atmosphere while bypassing the reference orifice 406. In this scenario, pressure in emissions control system 251 decreases while pump 238 is in operation and the pressure in emissions control system 251 may be monitored by pressure sensor 296. When the pressure in emissions control system 251 equals the target vacuum, the CPV is opened and a first rate of decay of a pressure of an evaporative emissions control system to a target pressure may be monitored for diagnosing the canister restriction. For example, if the first rate of decay is less than a first threshold rate of decay when evacuating the canister to the atmosphere, restriction of an element of the canister may be indicated.

When diagnosing a restriction source, CPV 261 may be closed, and FTIV 252 may be closed to allow pump 238 to isolate canister 222 from fuel tank 220. In this configuration, the pump may be operated to draw air from emissions control system 251 through the pump and to the atmosphere while bypassing the reference orifice 406, as shown in FIG. 6. In this scenario, pressure in emissions control system 251 decreases while pump 238 is in operation and the pressure in emissions control system 251 may be monitored by pressure sensor 296. When the pressure in emissions control system 251 equals the target vacuum, the FTIV is opened and a second rate of decay of a pressure of the evaporative emissions control system to a target pressure may be monitored for diagnosing the restriction source. For example, if the second rate of decay is less than a second threshold rate of decay when evacuating the canister to the fuel tank, restriction of the canister bed or degradation of the FTIV may be indicated, as further described in FIG. 9. However, if the second rate of decay is not less than the second threshold rate of decay when evacuating the canister to the fuel tank, restriction of the canister filter 226 or no degradation of the FTIV may be indicated, as described in FIG. 9.

During estimation of a remaining lifetime of canister filter 226, the COV is in the first position, and pump 238 is de-activated. This configuration allows for air to freely flow between atmosphere and canister 222. Upon evacuating evaporative emissions control system 251 (with CPV 261 closed and FTIV 252 closed) to the reference pressure, the purge valve may be opened and a rate of vacuum decay and a duration to stabilize to the atmospheric pressure may be monitored for the estimation of the remaining lifetime of canister filter 226. Further, at a time point when CPV 261 is opened (that is, when CPV 261 is changed from a closed position to a fully open position), a ELCM pressure sensor output of pressure sensor 296 and a MAP sensor output of MAP sensor 291 may be monitored to determine an initial pressure drop across the canister. The initial pressure drop may provide an indication of whether the canister filter is partially restricted or fully restricted. For example, if it is determined that the initial pressure drop is greater than a threshold difference, full restriction of the canister filter may be indicated; otherwise partial restriction of the canister filter is indicated. Still further, this configuration may also be used during a canister purging operation, for example.

Further, upon indication of the canister filter 226 being restricted, the canister filter may be regenerated. The COV is in the second position, and pump 238 is activated in the first direction, as shown in FIG. 6. This configuration allows pump 238 to pull air flow across the canister filter 226 towards a dust trap. When regenerating the canister filter, CPV 261 may be opened, and FTIV 252 may be closed, allowing air to be pulled from the engine intake 223 across the canister filter 226.

In this way, a pump (such as pump 238) coupled with a leak check module (such as ELCM 295) may be utilized for diagnosing a canister filter (such as canister filter 226) integrated within a fuel vapor canister (such as canister 222) and regenerating a restricted canister filter (such as canister filter 226).

Details of diagnosing a restriction of a canister filter, a degree of restriction, estimating a remaining lifetime of a canister filter, diagnosing a restriction of a canister bed, and regenerating a restricted filter will be further elaborated with respect to FIGS. 8-12.

In one example, the systems of FIGS. 1 and 2 may be configured with a system for a hybrid electric vehicle, comprising: an emissions control system including a fuel vapor canister, a purge line coupling the canister to an engine via a purge valve, and a conduit coupling the canister to a fuel tank via a fuel tank isolation valve, an integrated filter arranged in the canister, a pump integrated within an evaporative leak check module (ELCM), the ELCM arranged within a vent line of the canister, and a pressure sensor in the ELCM. The system may also include a controller with instructions stored in non-transitory memory, that when executed during an engine off condition, cause the controller to: close each of the purge valve and the fuel tank isolation valve, and diagnose a restriction of the canister based on a first rate of decay of a pressure of an evaporative emissions control system being less than a first threshold rate of decay during evacuation of the canister to atmosphere. The instructions may also cause the controller to identify a source of restriction as an integrated filter or a canister bed of the carbon canister, or a fuel tank isolation valve (FTIV) based on a second rate of decay of a pressure of the evaporative emissions control system being less than a second threshold rate of decay, when evacuating the canister to the fuel tank.

The controller is further configured with instructions stored in non-transitory memory, that when executed, cause the controller to: in response to diagnosing the restriction, close the purge valve, close the FTIV, and regenerate the filter by operating the pump for a duration to pull air flow across the filter towards a dust trap.

As described above, a fuel vapor canister may be configured with an integrated filter, such as an internal carbon dust filter. FIG. 7 schematically shows an example fuel vapor canister 702 with an integrated carbon dust filter 704, a purge port 706, a load port 708, a fresh air port 710, a bleed element 712, and a canister bed 714. The fuel vapor canister 702 may be an example of the canister 222 of FIG. 2. The purge port 706 couples the canister 702 with a purge line, such as, for example, the purge line 228 of FIG. 2. The load port 708 couples the canister 702 to a fuel line, such as, for example, the conduit 278 of FIG. 2. The fresh air port 710 couples the canister 702 to a canister vent line, such as, for example, the canister vent line 227 of FIG. 2. The canister bed 714 may be configured with carbon pellets with microscopic pores to trap and adsorb hydrocarbons from fuel vapors. Over time, carbon dust may break away from the pellets and migrate to a purging valve, such as, for example, CPV 261 of FIG. 2. The carbon dust may cause a leak in the CPV, which may in turn cause degradation of the fuel tank. The filter 704 may aid in reducing migration of carbon dust from the canister bed 714 to the purge line, thus reducing clogging of the purge valve. However, the filter 704 may in turn collect migrating carbon dust and become restricted, thus reducing a filtering ability of the filter 704. An effect of a restricted filter may include an inability of the canister to be purged. For example, a communication of vacuum from a vacuum source, such as an intake manifold of an engine, may be blocked due to the restricted filter. Purging of hydrocarbons from the canister may be inhibited as a result. Additionally, air flow between the canister bed 714 and the fresh air port 710, and between the canister bed 714 and the load port 708 may not pass through the filter 704, therefore restriction of the canister bed 714 may be differentiated from restriction of the filter 704 by venting the canister vacuum to the fuel tank to determine restriction of the canister bed 714 or to the atmosphere to determine restriction of the filter 704.

Figure 8A:
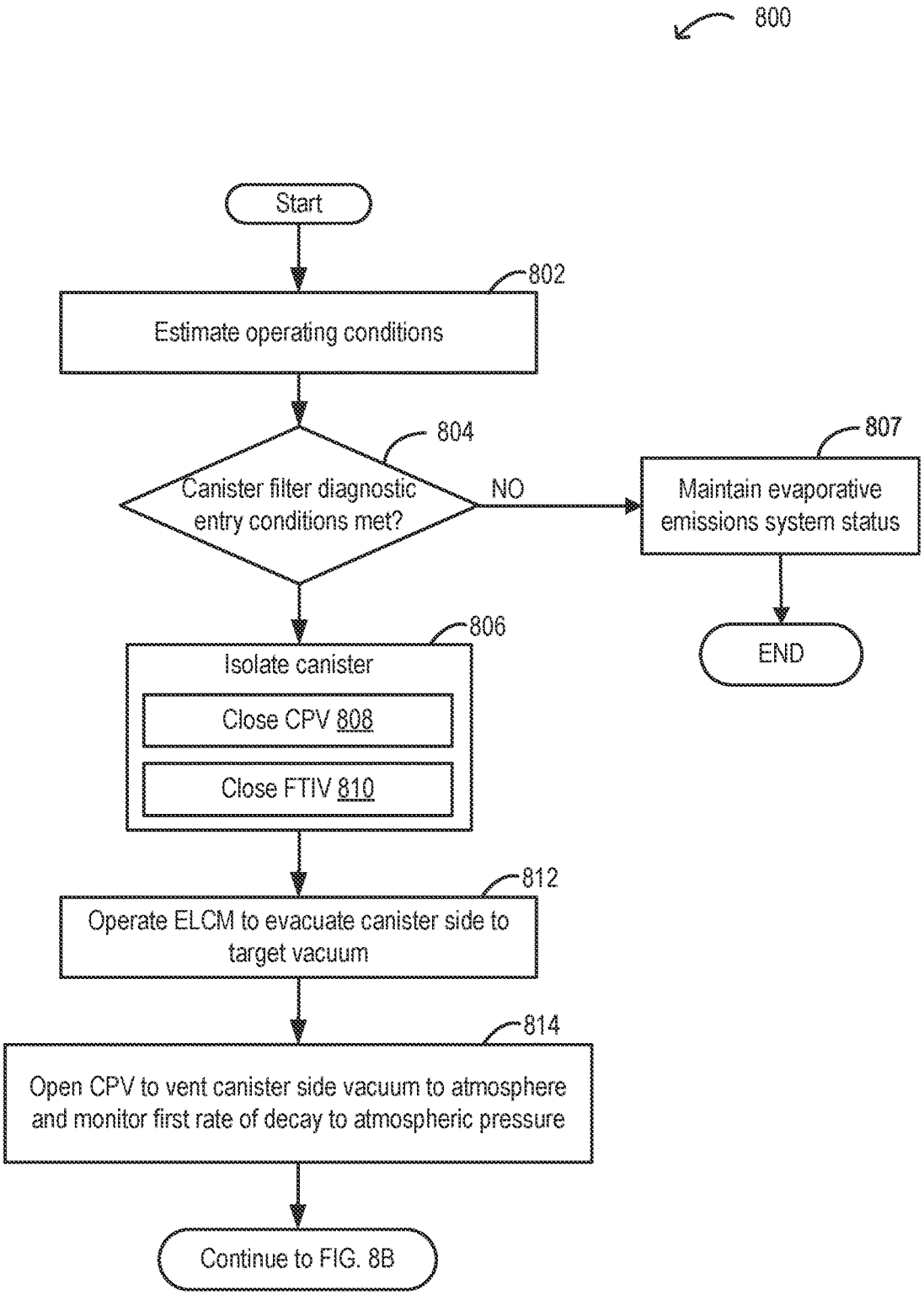
FIGS. 8A-B show a flow chart for an example method for determining canister filter restriction.
Figure 8B:
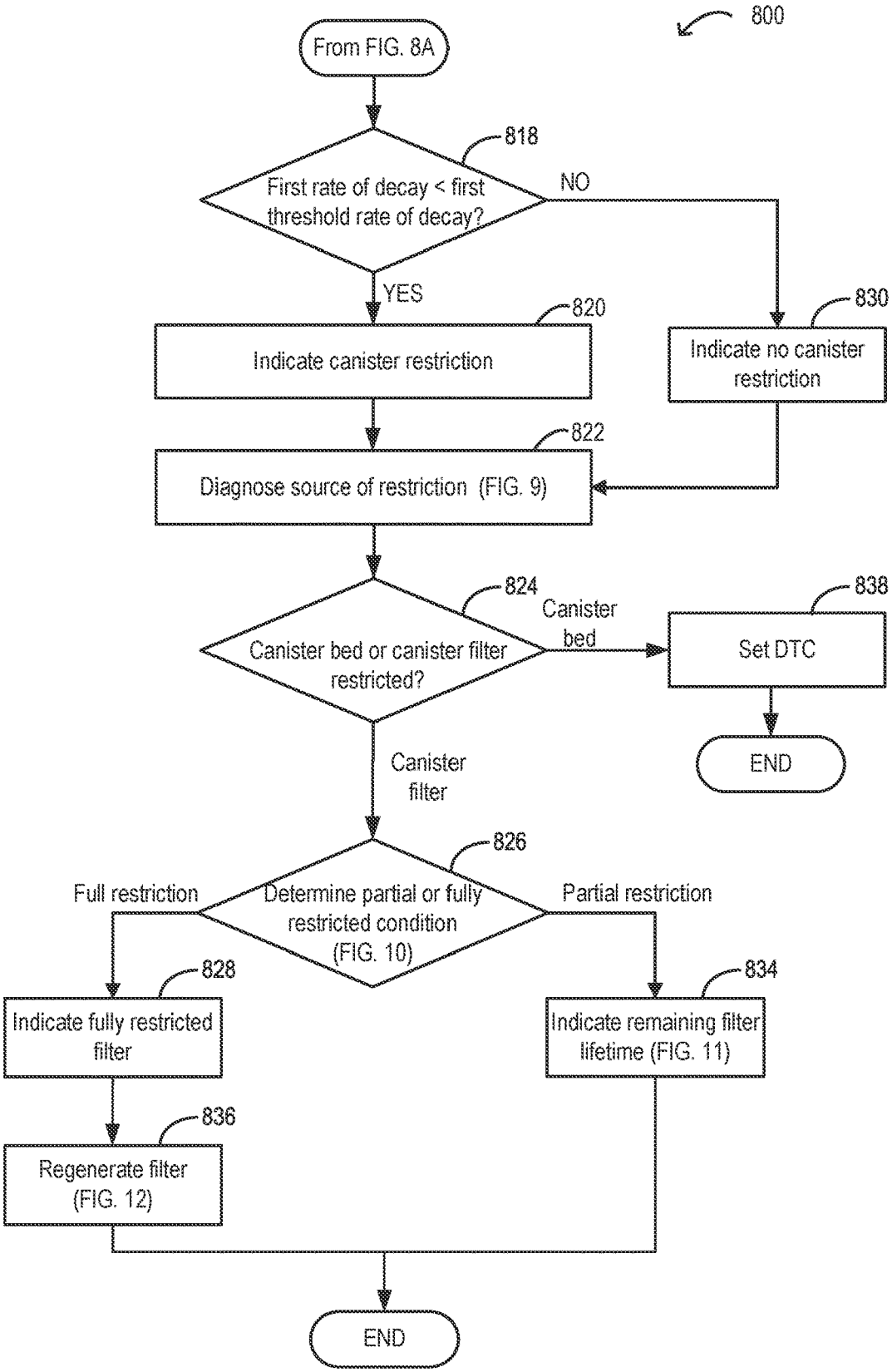
Figure 9:
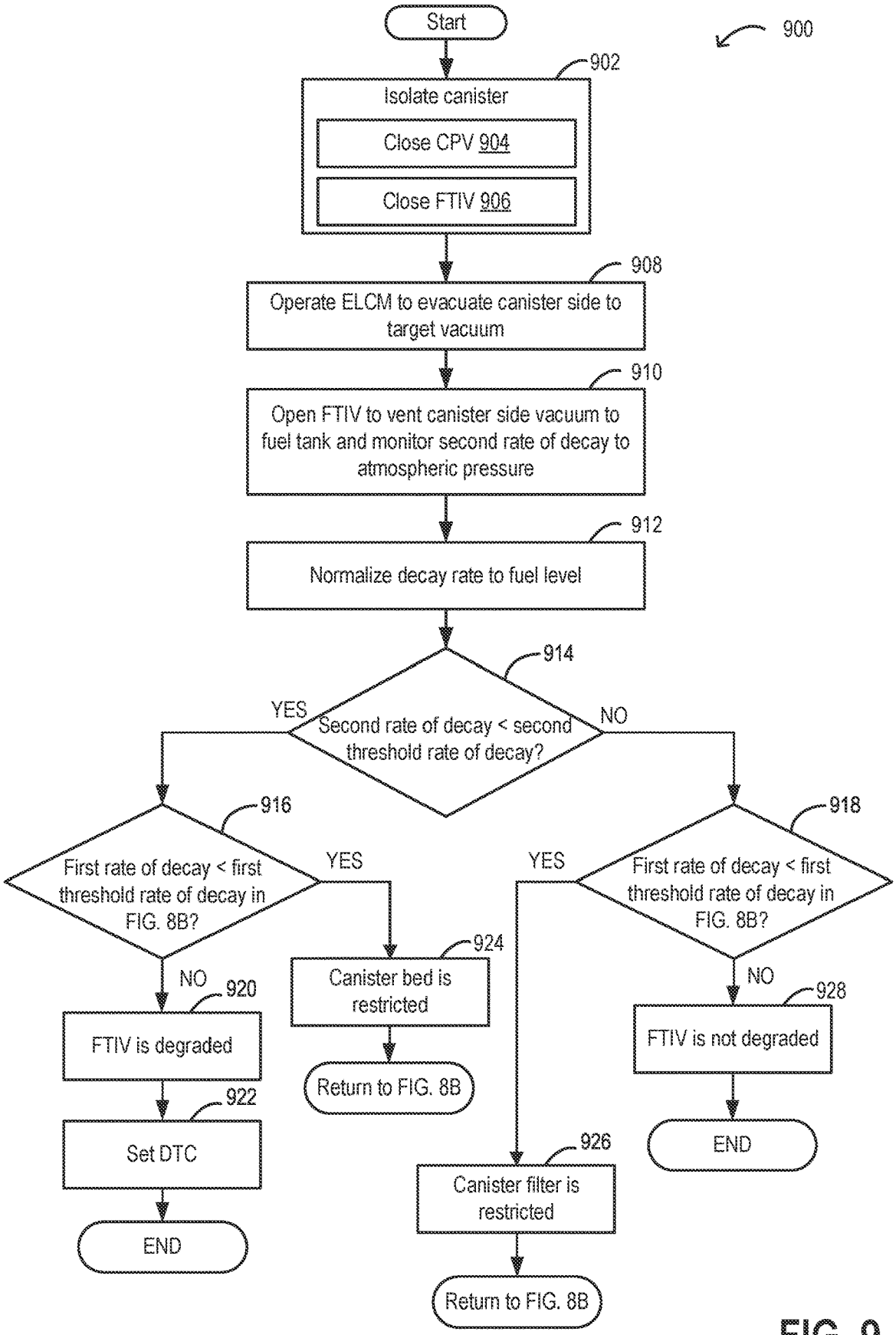
FIG. 9 shows a flow chart for an example method for determining a canister restriction source.
Figure 10:
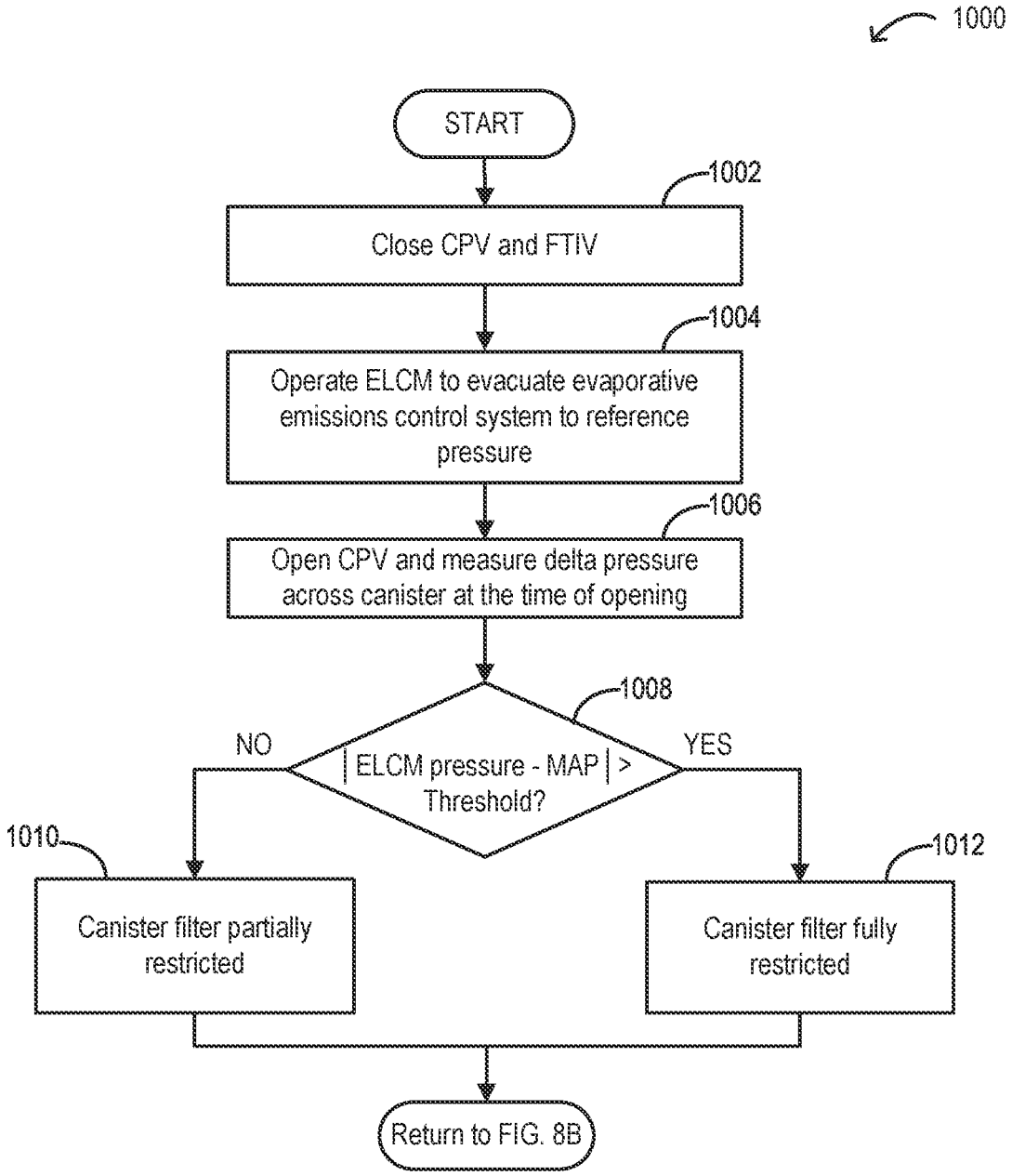
FIG. 10 shows a flow chart for an example method for estimating a remaining lifetime of a canister filter.
Figure 11:
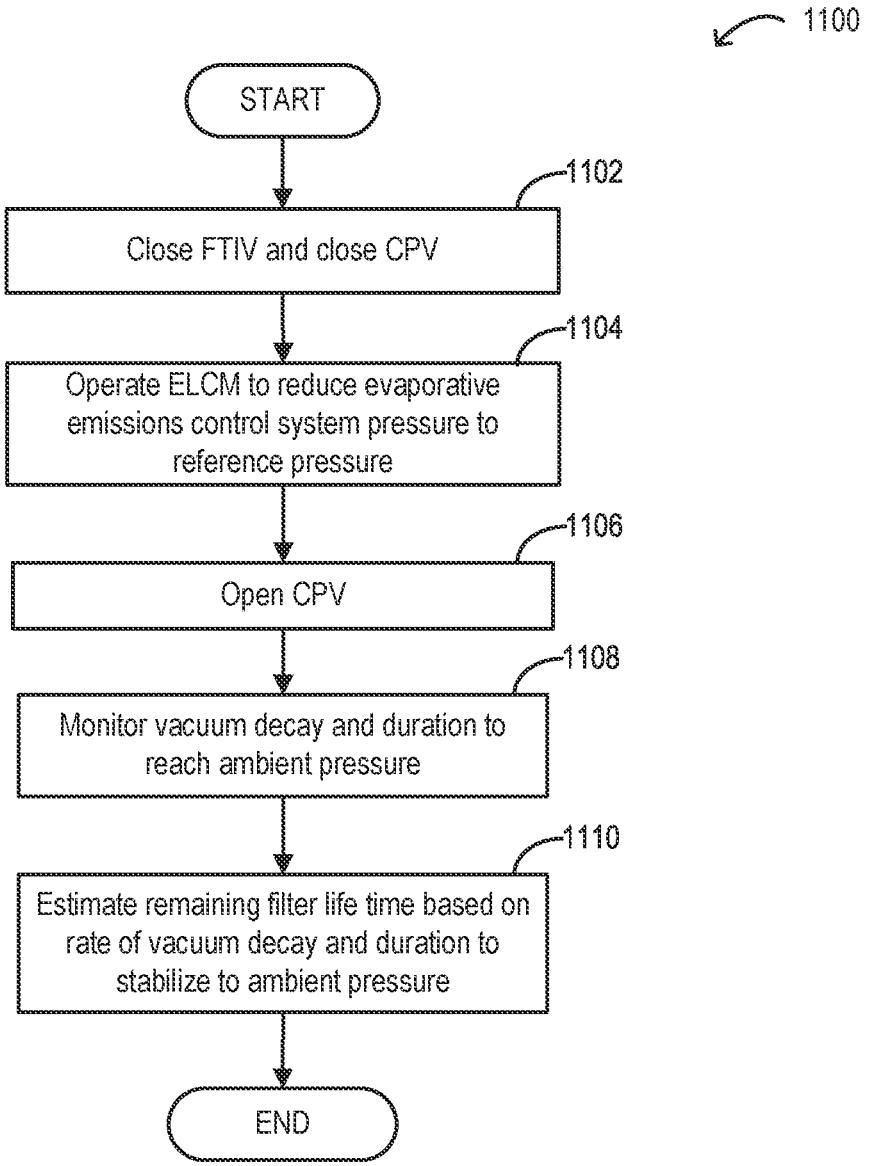
FIG. 11 shows a flow chart for an example method for determining canister bed and canister filter restriction.

FIGS. 8-12 describe methods for diagnosing restriction and a degree of restriction of the canister filter, estimating a remaining lifetime of a canister filter, diagnosing a restriction of a canister bed, and regenerating a restricted filter. A list of possible diagnostic results of the methods described in FIGS. 8 and 11 are shown below in Table 1, where Part I Diagnostic refers to the method of FIGS. 8A-B and Part II Diagnostic refers to the method of FIG. 11. The "decay of vacuum" in the Part I Diagnostic refers to a first rate of decay of pressure of an evaporative emissions control system to a target pressure, and the "decay of vacuum" in the Part II Diagnostic refers to a second rate of decay of pressure of an evaporative emissions control system to a target pressure. "Rapid decay of vacuum" is defined as a rate of decay being equal to or greater than (e.g., faster than) a threshold rate of decay. "Slow decay of vacuum" is defined as a rate of decay being less than the threshold rate of decay.

TABLE 1

Truth table for canister filter and canister bed restriction diagnosis

| Part I Diagnostic | Part II Diagnostic | Result |
|---|---|---|
| Rapid decay of vacuum | Rapid decay of vacuum | Unrestricted filter, unrestricted canister bed |
| Slow decay of vacuum | Slow decay of vacuum | Restricted canister bed. Set DTC, replace canister |
| Slow decay of vacuum | Rapid decay of vacuum | Restricted canister filter. Perform regeneration |
| Rapid decay of vacuum | Slow decay of vacuum | FTIV stuck closed/restricted. Set DTC, investigate valve |

FIGS. 8A-B, which correspond to Part I diagnostics of Table 1, show an example of a high-level method 800 for performing canister filter diagnostics utilizing an ELCM (such as ELCM 295) in a plug-in hybrid vehicle in accordance with the present disclosure. Method 800 will be described with relation to the systems shown in FIG. 2, but it should be understood that similar methods may be used with other systems without departing from the scope of this disclosure. Instructions for carrying out method 800 and the rest of the methods included herein may be executed by a controller (such as controller 212) based on instructions stored on a memory of the controller and in conjunction with signals received from sensors of the engine system, such as the sensors described above with reference to FIGS. 1, 2, and 7. The controller may employ engine actuators of the engine system to adjust engine operation, according to the methods described below.

Method 800 may begin at 802 by estimating operating conditions. Operating conditions may include various vehicle conditions, such as vehicle operating mode, etc., various engine operating conditions, such as engine operating mode, etc., and various ambient conditions, such as temperature, barometric pressure, humidity, date, time, etc. In addition to engine conditions, fuel system conditions may also be monitored, such as fuel tank pressure, etc. Operating conditions may be measured by one or more sensors coupled to a controller, such as sensors 216 shown coupled to controller 212, or may be estimated or inferred based on available data.

Method 800 proceeds to 804 after evaluating operating conditions. At 804, method 800 includes determining if entry conditions for performing a canister filter diagnosis are present. In one example, canister filter diagnostic conditions may include engine-off conditions following a vehicle key-off event. In another example, canister filter diagnostic conditions may include engine-off conditions while the vehicle is being operated using an auxiliary power source. For example, in hybrid vehicle applications, engine-off conditions may occur during vehicle operation while the vehicle is in motion with the engine-off. In another example, entry conditions may be based on an amount of time or distance driven since a previous canister filter diagnosis greater than a threshold amount of time. In still another example, canister filter diagnosis may be based on leak testing in an emission control system and/or a fuel system, as described above. For example, canister filter diagnosis may be performed prior to performing an engine-off EVAP leak test when EVAP leak test entry conditions are met. As such, the leak test may be performed during engine-off conditions when operating conditions indicate that ambient temperature, barometric pressure, and/or fuel tank level are in a range for performing the test.

If entry conditions are not met at 804, method 800 proceeds to 807. At 807, method 800 includes maintaining an evaporative emissions system status. For example, a FTIV and a CPV may be maintained in open positions during vehicle-off and engine-off conditions to direct diurnal vapors from the tank to the canister, and to vent the air stripped of fuel vapors to the atmosphere via the canister vent valve. Method 800 may then end.

If entry conditions are met at 804, method 800 proceeds to 806. At 806, method 800 includes isolating the canister from the engine and the fuel tank by closing a purge valve (such as CPV 261) at 808, and closing a FTIV (such as FTIV 252) at 810. A vent valve may be maintained in an open position. At 812, method 800 includes operating the ELCM to evacuate a canister side of the evaporative emissions control system to a target vacuum. Operating the ELCM includes adjusting the COV to the second position and operating the pump to evacuate the evaporative emissions control system, with air flow indicated in FIG. 6 by arrows 604. In one example, the target vacuum is −12 InH2O. The canister side may include a portion of a purge line (such as purge line 228) between the purge valve and the canister, the canister, a portion of a conduit between the canister and the FTIV (such as fuel line 278), and a canister vent line (such as vent line 227) leading up to the atmosphere.

At 814, method 800 includes opening the CPV to vent the vacuum created at the canister side to the atmosphere. Further, at 814, method 800 includes monitoring a first rate of decay of pressure at the canister side to a target pressure. In one example, the target pressure is atmospheric pressure.

Method 800 continues from 814 to 818 of FIG. 8B, where method 800 includes determining if the first rate of decay is less than a first threshold rate of decay. The first threshold rate of decay is based on a time to evacuate an emissions control system including a canister configured with a new canister filter. For example, the first threshold rate of decay may be determined during a manufacturing process and stored in a memory of the controller. Specifically, the first threshold rate of decay may be established in the assembly plant at an end of line station. In another example, the first threshold may be determined when the vehicle is in service when the canister/filters are replaced. For example, in an evaporative emissions control system with integrity, e.g., with no leaks, if the canister filter is restricted, air flow through the canister decreases, compared to an unrestricted filter, and therefore, a rate of pressure decay when venting the canister to the atmosphere may be less than a first threshold rate of decay.

If the first rate of decay is not less than the first threshold rate of decay (the first rate of decay is faster than or the same rate as the first threshold rate of decay and the pressure rapidly decays to atmospheric pressure) it may be determined that the canister is not restricted. Accordingly, method 800 proceeds to 830 at which method 800 indicates the canister is not restricted. Indicating that the fuel vapor canister is not restricted may include displaying a notification at, for example, a dashboard user interface of the vehicle, such as the instrument panel 196 of FIG. 1. However, as shown in Table 1, the first rate of decay being greater than the first threshold rate of decay may not diagnose a status of the FTIV, e.g., if the FTIV is degraded and stuck in a closed or partially closed position. Thus, method 800 may proceed to 822 to determine the status of the FTIV. At 822, method 800 proceeds to method 900 of FIG. 9, further described below, to diagnose a canister restriction source, which also enables diagnosis of the FTIV.

If the answer at 818 is YES, then the first rate of decay is less than the first threshold rate of decay (the first rate of decay is slower than the first threshold rate of decay and the pressure slowly decays to atmospheric pressure) indicating the canister filter may be restricted. Accordingly, at 820, method 800 includes indicating a canister restriction is detected. Indicating a restriction of the canister may include setting a flag or code at the controller.

While the first rate of decay may be less than the first threshold rate of decay due to a restricted canister filter, there may be additional circumstances that reduce the first rate of decay. For example, carbon dust from carbon pellets of a canister bed, such as, for example, the canister bed 714 of FIG. 7, may restrict the canister bed itself. In another example, liquid fuel that has entered the canister via a conduit, such as, for example, fuel line 278 of FIG. 2, or another contaminant may also restrict the canister bed. Therefore, the canister filter and the canister bed may be further examined, as described with reference to FIG. 9, to determine if the canister filter or the canister bed are restricted.

Returning to FIG. 8B, upon indication of a canister restriction at 820, method 800 proceeds to 822 to diagnose the canister restriction source according to method 900 of FIG. 9, further described below. At 824, method 800 includes confirming if the canister bed or the canister filter is the restricted element, based on results of method 900. If the canister bed is restricted, method 800 proceeds to 838 to set a diagnostic trouble code (DTC) that may prompt the operator to replace the canister. Method 800 ends.

If the canister filter is restricted, method 800 proceeds to 826. to determine if the canister filter is fully restricted or partially restricted according to method 1000 of FIG. 10. The determination of partial or full canister filter restriction may be based on an initial pressure difference across the canister. Details of method 1000 will be further elaborated below.

If it is determined that the canister filter is partially restricted, method 800 proceeds to 834. to indicate a remaining lifetime of the canister filter, details of which will be elaborated with respect to FIG. 11. Indicating the remaining canister filter lifetime may include setting a flag or code at the controller, and may further include illuminating a malfunction indicator lamp (MIL).

If it is determined that the canister filter is fully restricted, method 800 proceeds to 828 to indicate that the canister filter is fully restricted. Indicating a full restriction in the canister filter may include setting a flag or code at the controller, and may further include illuminating a malfunction indicator lamp (MIL). Still further, upon indicating full restriction of a canister filter, the controller may suspend leak diagnostics until corrective actions (such as replacing the canister filter or cleaning the canister filter) are performed.

Corrective actions may include regenerating the fully restricted canister filter. Method 800 proceeds to 836, which includes regenerating the canister filter according to method 1200 of FIG. 12. After the restricted canister filter is regenerated, method 800 ends.

Turning to FIG. 9, which corresponds to Part II diagnostics of Table 1, method 900 shows an example of a method 900 for performing canister filter and canister bed diagnostics to determine if the canister filter or the canister bed is the restricted element utilizing an ELCM (such as ELCM 295) in a plug-in hybrid vehicle in accordance with the present disclosure. Method 900 will be described with relation to the systems shown in FIGS. 2 and 7, but it should be understood that similar methods may be used with other systems without departing from the scope of this disclosure. Method 900 may be stored as instructions in non-transitory memory and carried out by a controller, such as controller 212 shown at FIG. 2.

Method 900 begins at 902 by isolating the canister from the engine and the fuel tank. Isolating the canister may include closing the purge valve (such as CPV 261) at 904, and closing the FTIV (such as FTIV 252) at 906. The vent valve of the canister may be maintained in an open position. At 908, method 900 includes operating the ELCM to evacuate the canister side of the evaporative emissions control system to a target vacuum. Operating the ELCM includes adjusting the COV to the second position and operating the pump to evacuate the evaporative emissions control system, with air flow indicated by arrows 604, as shown in FIG. 6. In one example, the target vacuum is −12 InH2O.

At 910, method 900 includes opening the FTIV to vent the vacuum created at the canister side to the fuel tank. Further, at 910, method 900 includes monitoring a second rate of decay of pressure to a target pressure. In one example, the target pressure is atmospheric pressure.

Method 900 proceeds from 910 to 912 to normalize the second rate of decay to a fuel level of the fuel tank, such as fuel tank 220 of FIG. 2. For example, normalizing the second rate of decay may involve dividing the rate of decay by the fuel level.

Method 900 proceeds to 914 to determine if the second rate of decay is less than a second threshold rate of decay. The second threshold rate of decay is based on a time to evacuate an emissions control system that includes a canister with a new canister filter and a new canister bed. For example, the second threshold rate of decay may be determined during a manufacturing process and stored in a memory of the controller. In another example, the second threshold may be determined when the vehicle is in service when the canister is replaced. For example, in an evaporative emissions control system with integrity, if the canister filter and/or the canister bed are restricted, air flow through the canister may decrease, compared to an unrestricted canister filter and/or canister bed, and therefore, a rate of pressure decay when venting the canister to the fuel tank may be less than the second threshold rate of decay.

If the second rate of decay is less than the second threshold rate of decay (the second rate of decay is slower than the second threshold rate of decay) the canister bed may be restricted. However, other canister elements may be restricted, which may be diagnosed based on the first rate of decay (e.g., as described in method 800). At 916, method 900 refers to 818 of FIG. 8B to confirm if the first rate of decay is less than the first threshold rate of decay. If method 800 identified the first rate of decay to be less than the first threshold rate of decay, method 900 includes confirming the canister bed is restricted at 924. During Part I diagnostic, as described with reference to Table 1 and method 800 of FIGS. 8A-8B, when vacuum decay is slow (indicated by the first rate of decay being less than the first threshold rate of decay) and additionally, during Part II diagnostic as shown in Table 1 and described with reference to method 900, there is slow vacuum decay (indicated by the second rate of decay being less than the second threshold rate of decay), then the canister bed may be deemed restricted. Method 900 returns to FIG. 8B.

Returning to 916, if the first rate of decay is not less than the first threshold rate of decay (as determined at method 800) method 900 proceeds from 916 to 920 to confirm the FTIV is degraded, which may include the FTIV being stuck in a closed position or restricted by contaminants, such as carbon dust. As described in Table 1, if rapid vacuum decay is detected during Part I diagnostic (indicated by the first rate of decay not being less than the first threshold rate of decay), and, slow vacuum decay is detected during Part II diagnostic (indicated by the second rate of decay being less than the second threshold rate of decay), then the FTIV may be stuck in a closed position or otherwise restricted. At 922, a DTC is set to alert an operator to investigate the FTIV, and method 900 ends.

Returning to 914, if the second rate of decay is not less than the second threshold rate of decay (the second rate of decay is faster than the second threshold rate of decay) the canister filter may be restricted. However, other canister elements may be restricted, which may be diagnosed based on the first rate of decay (e.g., as described in method 800). At 918, method 900 includes confirming if the first rate of decay is less than the first threshold rate of decay (e.g., as shown at 818 of method 800). If the first rate of decay is less than the first threshold rate of decay, method 900 confirms that the canister filter is restricted at 926. For example, as described with reference to Table 1 and method 800, if vacuum decay is slow during Part I diagnostic (indicated by the first rate of decay being less than the first threshold rate of decay), and, vacuum decay is rapid during Part II diagnostic, as described in method 900 (indicated by the second rate of decay not being less than the second threshold rate of decay), then the canister filter is deemed restricted. Method 900 returns of FIG. 8B.

Returning to 918, if the first rate of decay is not less than the first threshold rate of decay, method 900 proceeds to 928 to confirm no degradation of the FTIV. As described in Table 1, if during Part I diagnostic, as described in FIGS. 8A-B, there is rapid vacuum decay, as may be indicated by the first rate of decay not being less than the first threshold rate of decay, and, during Part II diagnostic, as described in FIG. 9, there is rapid vacuum decay, as may be indicated by the second rate of decay not being less than the second threshold rate of decay, then both the canister bed and the canister filter may be unrestricted. Therefore, method 900 confirms no restriction and method 900 ends.

In one example, both the canister filter and the canister bed may be restricted. If both elements are restricted, air flow across the canister may still be restricted due to restriction of the canister bed after regenerating the canister filter according to method 1200. A diagnostic method may instead set a DTC to indicate the canister bed is restricted and prompt the operator to replace the canister.

Turning to FIG. 10, a flow chart for an example high-level method 1000 for determining a degree of restriction of a canister filter (such as canister filter 226 of FIG. 2) is shown. Specifically, method 1000 may include determining if the fuel vapor canister filter is fully restricted or partially restricted. Method 1000 will be described with relation to the systems shown in FIGS. 2 and 7, but it should be understood that similar methods may be used with other systems without departing from the scope of this disclosure. Method 1000 may be stored as instructions in non-transitory memory and carried out by a controller, such as controller 212 shown at FIG. 2.

Method 1000 may continue from 826 of method 800, where the FTIV is in the open position and the CPV is the open position. At 1002 of method 1000, the CPV and FTIV are closed. Method 1000 proceeds to 1004 to operate the ELCM to evacuate the evaporative emissions control system to a reference pressure. Operating the ELCM includes adjusting the COV to the second position, as shown in FIG. 6. The reference pressure may be determined prior to performing the canister filter diagnostics when canister filter entry conditions are met by operating the ELCM to draw air from the evaporative emissions control system through a reference orifice. For example, the pump in the ELCM may be actuated while the COV, for example, COV 402 of FIG. 4, is depowered in the first position. The pump is located in the vent path of the fuel vapor canister in the emission control system and draws a quantity of air from the emission control system through the reference orifice to obtain the reference pressure based on the size or diameter of the orifice.

Returning to FIG. 10, method 1000 may proceed from 1004 to 1006 to open the CPV and measure a pressure difference across the canister at the time of the opening. By measuring the pressure difference, the canister filter may be diagnosed as partially or fully restricted. The pressure difference is determined based on a MAP sensor output from a MAP sensor (such as sensor 291 of FIG. 2) and an ELCM pressure sensor output from an ELCM pressure sensor (such as pressure sensor 296 of FIG. 2) at a time when the purge valve is commanded open.

Next, at 1008, method 1000 includes determining if the pressure difference, which is determined as |ELCM pressure−MAP|, across the canister is greater than a threshold pressure difference. For example, the threshold pressure difference may be determined during a manufacturing process and stored in a memory of the controller. Specifically, the threshold pressure difference may be established in the assembly plant at an end of line station. In another example, the threshold pressure difference may be determined when the vehicle is in service when the canister/filters are replaced. The pressure difference across the canister at the time of purge valve opening may provide an indication of whether the canister filter is fully restricted or partially restricted. For example, if the canister filter is fully restricted, the pressure drop across the canister at the time of purge valve opening is large compared to the pressure drop when the canister filter is partially restricted. Subsequently, the pressure difference decreases and the MAP sensor output and the ELCM pressure sensor output converge over time.

If the pressure difference is greater than the threshold, method 1000 proceeds to 1012. At 1012, method 1000 confirms full restriction of canister filter. Method 1000 returns to FIG. 8B.

If the pressure difference is less than the threshold, method 1000 proceeds to 1010 to confirm partial restriction of the canister filter. Method 1000 returns to FIG. 8B. In this way, MAP sensor output and ELCM pressure sensor output may be utilized to determine full or partial restriction of the canister filter.

Turning to FIG. 11, an example of a method 1100 for estimating a remaining lifetime of a canister filter is shown. Method 1100 may be carried out at 834 of FIG. 8 to estimate a remaining lifetime of the canister filter is response to determining partial restriction of the fuel vapor canister. Method 1100 will be described with relation to the systems shown in FIGS. 2 and 7, but it should be understood that similar methods may be used with other systems without departing from the scope of this disclosure. Method 1100 may be stored as instructions in non-transitory memory and carried out by a controller, such as controller 212 shown at FIG. 2.

Method 1100 begins at 1102 by closing the FTIV (such as FTIV 252) and the purge valve (such as CPV 261) to isolate the canister side volume of the emissions control system (such as emissions control system 251) from the fuel tank (such as fuel tank 220) and the engine (such as engine 210).

The vent valve disposed in the vent line (such as vent line 227) may be maintained in the open position.

Next, at 1104, method 1100 includes operating the ELCM to evacuate the canister side volume of the evaporative emissions control system such that a pressure in the evaporative emissions control system measured by a ELCM pressure sensor output is decreased to the reference pressure as described above with reference to 1004 of method 1000. The canister side volume includes a portion of the conduit between the purge valve and the canister, the canister, a portion of the conduit between the canister and the FTIV, and the canister vent line leading up to the atmosphere. As such, the reference pressure may be obtained by operating the ELCM to draw a quantity of air from the evaporative emissions control system through the reference orifice.

Upon the pressure in the emissions control system reaching the reference pressure, method 1100 proceeds to 1106 to open the CPV. Next, at 1108, method 1100 includes monitoring a rate of vacuum decay (or change in pressure) of the emissions control system and a duration for the pressure of the emissions control system to stabilize to ambient pressure. The rate of vacuum decay of the emissions control system is determined based on the ELCM pressure sensor output.

Next, method 1100 proceeds to 1110 to estimate a remaining filter lifetime based on the rate of vacuum decay and the duration to stabilize to ambient pressure. For example, as a percentage of restriction increases, the rate of vacuum decay decreases and the duration to stabilize to ambient pressure increases, and method 1100 ends. In this way, the ELCM is utilized to estimate a remaining lifetime of a canister filter.

Figure 12:
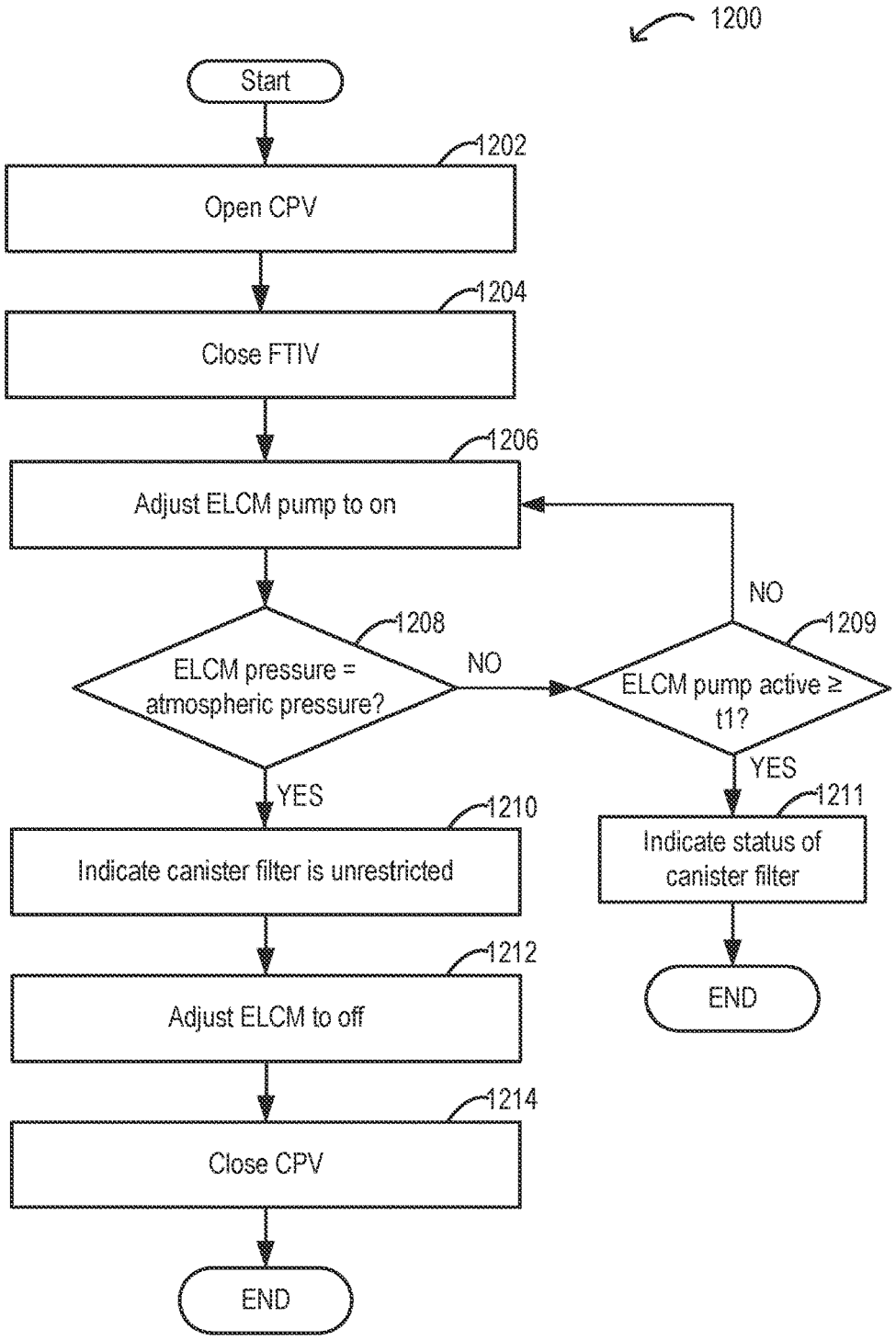
FIG. 12 shows a flow chart for an example method for regenerating a restricted canister filter.

Turning to FIG. 12, an example of a method 1200 for regenerating a fully restricted canister filter is shown. Method 1200 may be carried out at 836 of FIG. 8B to regenerate the fully restricted filter using the ELCM in response to indication of a fully restricted canister filter. Method 1200 will be described with relation to the systems shown in FIGS. 2 and 7, but it should be understood that similar methods may be used with other systems without departing from the scope of this disclosure. Method 1200 may be stored as instructions in non-transitory memory and carried out by a controller, such as controller 212 shown at FIG. 2. Additionally, method 1200 may be performed when the canister has a fuel vapor-free status, that is, the canister has been evacuated of fuel vapors.

Method 1200 begins by opening the purge valve (such as CPV 261) at 1202 to stimulate air flow. Method 1200 proceeds to 1204 to close or maintain closed the FTIV (such as FTIV 252).

Next, at 1206, method 1200 includes activating an ELCM pump (such as vacuum pump 238) in the second direction. This configuration allows the pump to pull air flow across the canister filter towards the dust trap (such as dust trap 259), drawing air from the engine intake (such as engine intake 223) across the canister filter. The COV is in the second position, as shown in FIG. 6. Activating the ELCM pump in the second direction uses the pump as a vacuum cleaning source to force air flow across the canister filter in a reverse direction compared to nominal operation, which may dislodge contaminants, such as carbon dust, from the canister filter. Dislodged contaminants may be direction to the dust box, which may have a greater capacity for trapping contaminants compared to the canister filter.

Method 1200 proceeds to 1208 to determine if the ELCM pressure, as determined based on the ELCM pressure sensor output, is equal to atmospheric pressure. If the ELCM pressure is not equal to atmospheric pressure, method 1200 proceeds to 1209 to determine if the ELCM pump has been activated for a time t1. Time t1 may be, for example, a threshold period of time between three to five minutes. Alternatively, time t1 may correspond to a time when a vacuum inflection point is reached if the vacuum inflection point occurs before the threshold period of time elapses. The vacuum inflection point may occur when an increasing vacuum in the canister is strong enough to dislodge contaminants restricting the canister filter. When the contaminants are dislodged, air may flow through the canister filter unrestricted, continue through the CPV, across the canister filter, and to the atmosphere via the vent line.

If the ELCM pump has not been active for time t1, method 1200 returns to 1206 to maintain the ELCM pump activated in the second direction. If the ELCM pump has been active for a duration greater than or equal to time t1, method 1200 times out and the filter is deemed to be restricted beyond an ability of the onboard system to regenerate the canister filter. A status of the canister filter is indicated at 1211. The indication may include, for example, setting a DTC, displaying a notification, illuminating a MIL, etc. Method 1200 ends.

If the ELCM pressure is equal to atmospheric pressure at 1208, method 1200 proceeds to 1210 to indicate the canister filter is unrestricted. At 1212, the ELCM is turned off, which includes turning off the pump. At 1214, the CPV is closed and method 1200 ends.

In this way, a restriction of a fuel vapor canister of an evaporative emissions control system may be diagnosed using an ELCM and a fully restricted canister filter of the fuel vapor canister may be regenerated by the ELCM. Additionally, for a partially restricted canister filter, a remaining filter lifetime may be estimated.

FIGS. 13-15 show graphs illustrating example pressures of an ELCM, as determined based on an ELCM pressure sensor, relative to time during execution of methods described in FIGS. 8, 9, and 12, respectively. FIG. 13 shows a first graph 1300 illustrating an example canister filter diagnostic cycle to determine restriction of the canister. FIG. 14 shows a second graph 1400 illustrating an example canister bed and canister filter diagnostic cycle to determine a restricted element of the canister or the evaporative emissions control system. FIG. 15 shows a third graph 1500 illustrating an example filter regeneration cycle for a fully restricted canister filter. FIGS. 13-15 will be described with relation to the systems shown in FIGS. 2 and 7, but it should be understood that similar methods may be used with other systems without departing from the scope of this disclosure. The y-axis represents pressure of the ELCM, where the pressure sensor may generate a pressure signal reflecting the pressure within ELCM. Vertical markers t0-t2 represent times of interest. The x-axis represents time, and time increases from the left side of the plot to the right side of the plot.

The first graph 1300 of FIG. 13 illustrates changes in pressure at the ELCM during canister restriction diagnosis. Marker t0 corresponds to 812 of FIG. 8B, where the CPV is closed and the FTIV is open. The ELCM is operated, e.g., the pump is activated in a second direction, to evacuate the canister side to a target vacuum, as shown in FIG. 6. The target vacuum is indicated by horizontal line 1303 in graph 1300. In one example, the target vacuum is −12 InH2O. Evacuation of the canister side to the target vacuum is shown by the decrease in pressure of plot 1304 from t0 to t1. At t1, pressure of the canister side as determined by the ELCM pressure sensor, is drawn down to the target vacuum. At t2, the CPV is opened and the FTIV is maintained closed. As described with respect to 814 of FIG. 8B, upon opening of the CPV, the canister vacuum is vented to the atmosphere and a first rate of decay is monitored. Graph 1300 shows three examples of possible first rates of decay. An unrestricted filter rate is shown by plot 1306, where the first rate of decay is equal to or greater than a first threshold rate of decay, and method 800 may indicate the canister filter is not restricted. The first threshold rate of decay may be a rate of decay falling within a range of decay rates between a rate of decay of a partially restricted filter and the unrestricted filter rate, in one example. In another example, the first threshold rate of decay is equal to the unrestricted filter rate. The partially restricted filter rate is shown by plot 1308, and may be lower than the first threshold rate of decay. A fully restricted filter rate is shown by 1310, where the canister filter may be restricted by contaminants to an extent where little to no air may flow across the canister filter. A fully restricted filter may have a rate of decay equal to or near zero.

Determining differentiation between a partially restricted and a fully restricted canister filter is described in method 1000 of FIG. 10. The first graph 1300 shows the rate at which each of a fully restricted, partially restricted, or unrestricted canister filter may vent to the atmosphere and for the canister pressure to equal atmospheric pressure. For example, an unrestricted filter may vent to atmospheric pressure more quickly than a partially or fully restricted canister filter. In the first graph 1300, horizontal line 1301 represents atmospheric pressure and the unrestricted filter rate indicated by plot 1306 depicts the pressure of the canister venting to atmospheric pressure rapidly, relative to plot 1308 and plot 1310. Additionally, the first graph 1300 shows exemplary results of 1110 of method 1100, where a remaining lifetime of the filter may be estimated by analyzing the respective rate of decay over time compared to atmospheric pressure. For example, the remaining lifetime of the filter may be a difference in pressure, as indicated by bracket 1312, over a pre-set duration of time between the fully restricted filter and the partially restricted filter. The remaining lifetime may be reported as a percentage of the total canister filter lifetime.

As discussed with reference to FIG. 8B, the canister restriction diagnosis may further include identifying a source of restriction amongst more than one canister elements, such as the canister filter and the canister bed. The second graph 1400 of FIG. 14 illustrates how changes in pressure of the canister may be used to differentiate restriction of the canister filter versus restriction of the canister bed.

Marker t0 of the second graph 1400 represents 902 of FIG. 9, where the FTIV is closed and the CPV is closed. The ELCM is operated, e.g., the pump is activated in the second direction, to evacuate the canister side to a target vacuum, as shown by FIG. 6. The target vacuum is represented by horizontal line 1403. In one example, target vacuum is −12 InH2O. Evacuation of the canister side to the target vacuum is shown by a decrease in pressure of the canister as indicated by plot 1404 between t0 and t1. At t1, pressure at the canister side of the evaporative emissions system, as determined by the ELCM pressure sensor, is equal to the target vacuum.

At t2, the FTIV is opened, as described with reference to 910 of FIG. 9, and the CPV remains closed. A vacuum in the canister is vented to the fuel tank and a second rate of decay is monitored. The second graph 1400 shows two examples of possible second rates of decay. Plot 1406 corresponds to an unrestricted canister bed rate, where the second rate of decay is equal to or greater than a second threshold rate of decay. The second threshold rate of decay may be a rate of decay between a rate of decay of a restricted canister bed and the unrestricted canister bed rate, in one example. In another example, the second threshold rate of decay is equal to the unrestricted canister bed rate. The restricted canister bed decay rate is shown by plot 1410, where the canister bed may be restricted by contaminants such that little to no air flows across the canister bed and the restricted canister bed rate is less than the second threshold rate of decay. The second graph 1400 therefore compares the rate at which the pressure of the restricted and the unrestricted canister bed reaches atmospheric pressure, as indicated by horizontal line 1401, during venting to the fuel tank. As depicted in the second graph 1400, the unrestricted canister bed (plot 1406) vents to atmospheric pressure faster than the restricted canister bed (plot 1410).

After identifying the canister filter as the restricted element of the fuel vapor canister, followed by diagnosis of full restriction of the canister filter, as determined when the pressure difference |ELCM pressure−MAP| across the canister is greater than the threshold pressure difference, the fully restricted canister filter may be regenerated according to method 1200 of FIG. 12. Changes in canister pressure during a regeneration cycle is illustrated by the third graph 1500 of FIG. 15. Marker t0 represents 1202 of FIG. 12, where the CPV is opened. Prior to t0, the CPV is closed and the FTIV is closed. The FTIV is closed and the ELCM pump is activated in the second direction from t0 to t1, causing canister pressure to decrease, as shown by plot 1504. This configuration allows the pump to pull air flow across the canister filter towards the dust trap, drawing air from the engine intake across the canister filter. Activating the ELCM pump in the second direction uses the pump as a vacuum cleaning source to force air flow across the canister filter, which may dislodge contaminants, such as carbon dust, from the canister filter. Dislodged contaminants may be directed to the dust box, which may have a greater capacity for trapping contaminants compared to the canister filter.

At t1, pressure of the canister equals a vacuum inflection point 1503, at which a vacuum pull of the pump is strong enough to dislodge contaminants restricting the canister filter. At t2, the canister vacuum vents to the atmosphere and canister pressure stabilizes to atmospheric pressure. Plot 1506 depicts the increase in canister pressure to atmospheric pressure as contaminants are dislodged and air flow increases across the canister filter. As described at 1210 of method 1200, when ELCM pressure equals atmospheric pressure, as indicated by horizontal line 1501 in FIG. 15, the canister filter is deemed unrestricted. In this way, a restricted canister filter may be regenerated by dislodging contaminants, such as carbon dust, via vacuum generated by a pump, such as the pump of the ELCM.

In this way, an onboard system configured to conduct evaporative emissions leak detection routines may also be utilized to diagnose a restriction at a canister. By detecting a source of restriction of the canister and regenerating a canister filter when the canister filter is deemed restricted, the onboard system, including an ELCM, is used to identify, evaluate, and restore a condition of the canister filter, which may prolong a canister filter lifetime and reduce on warranty and/or maintenance costs. Further, by onboard identification of the canister restriction source, such as the canister bed or a degraded FTIV, a vehicle operator may be alerted of a restricted canister element and prompted to address the issue (such as replacing the canister or FTIV), thereby mitigating lapsing of a warranty period as well as costs associated with manual diagnosis. Further, if canister filter restriction is diagnosed, evaporative emissions leak diagnostics may not be performed until the issue is addressed, allowing the filter to be cleared and therefore able to transmit vacuum at an engine intake to the evaporative emissions control system prior to conducting the leak diagnostics. Still further, by identifying canister filter restriction, and taking corrective actions based on the diagnosis, a purging efficiency of the canister may be maintained at a desired level. Thus, emissions may be reduced and fuel economy of a vehicle may be increased.

The technical effect of using an ELCM to diagnose a restricted fuel vapor canister is that a canister element causing the restriction may be identified based on changes in pressure at the fuel vapor canister. A further technical effect is that regeneration of the canister filter is executed automatically based on the diagnosis.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is provided for ease of illustration and description and may be performed in a different order to achieve the features and advantages of the example embodiments described herein. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The disclosure also provides support for a method, comprising: indicating restriction of an integrated canister filter of a fuel vapor canister responsive to, during evacuation of the canister to atmosphere, a first rate of decay of a pressure of an evaporative emissions control system to a first target pressure being less than a first threshold rate of decay, and during evacuation of the canister to a fuel tank, a second rate of decay of the pressure of the evaporative emissions control system to a second target pressure being greater than a second threshold rate of decay. In a first example of the method, the method further comprises automatically regenerating the integrated filter when the integrated filter is determined to be fully restricted. In a second example of the method, optionally including the first example, the method further comprises confirming a presence of a restriction in the evaporative emissions control system based on the first rate of decay and wherein confirming the presence of the restriction includes isolating a canister side of the evaporative emissions control system by closing a canister purge valve, closing a fuel tank isolation valve (FTIV), and evacuating a volume of air in the canister side by operating a pump located in a vent path of the canister. In a third example of the method, optionally including one or both of the first and second examples, the method further comprises, when a pressure of the canister side is equal to a target vacuum, opening the canister purge valve to vent the evaporative emissions control system to the atmosphere and monitoring the first rate of decay until the pressure of the canister side reaches the first target pressure and wherein the first target pressure is atmospheric pressure. In a fourth example of the method, optionally including one or more or each of the first through third examples, the method further comprises, when the first rate of decay is greater than the first threshold rate of decay, indicating the canister is not restricted and diagnosing a restriction source based on the second rate of decay. In a fifth example of the method, optionally including one or more or each of the first through fourth examples, the method further comprises, when the first rate of decay is less than the first threshold rate of decay, indicating restriction of the canister and diagnosing a restriction source based on the second rate of decay. In a sixth example of the method, optionally including one or more or each of the first through fifth examples, the method further comprises confirming a restriction source in the evaporative emissions control system based on the second rate of decay and wherein confirming the restriction source includes determining restriction at the canister filter or at a canister bed by isolating the canister side of the evaporative emissions control system and evacuating a volume of air in the canister side by operating a pump, and wherein the canister side of the evaporative emissions control system is isolated by closing the canister purge valve and closing the fuel tank isolation valve (FTIV). In a seventh example of the method, optionally including one or more or each of the first through sixth examples, the method further comprises, when the evaporative emissions control system pressure is equal to the target vacuum, venting the evaporative emissions control system to the fuel tank by opening the fuel tank isolation valve, and monitoring the second rate of decay until the pressure of the canister side equals the second target pressure and wherein the second target pressure is atmospheric pressure. In an eighth example of the method, optionally including one or more or each of the first through seventh examples, the method further comprises, when the first rate of decay is greater than the first threshold rate of decay and the second rate of decay is less than the second threshold rate of decay, indicating the FTIV is restricted by setting a diagnostic trouble code (DTC). In a ninth example of the method, optionally including one or more or each of the first through eighth examples, the method further comprises, when the first rate of decay is less than the first threshold rate of decay and the second rate of decay is less than the second threshold rate of decay, indicating the canister bed is restricted by setting a diagnostic trouble code (DTC). In a tenth example of the method, optionally including one or more or each of the first through ninth examples, the method further comprises, when the first rate of decay is less than the first threshold rate of decay and the second rate of decay is greater than the second threshold rate of decay, confirming restriction of the filter which includes one or more of determining partial or full restriction of the canister, estimating a remaining lifetime of the filter when the filter is partially restricted, and regenerating the filter when the filter is fully restricted. In an eleventh example of the method, optionally including one or more or each of the first through tenth examples, regenerating the filter includes opening the canister purge valve, closing the fuel tank isolation valve, and turning a pump on for a duration to pull air flow across the filter towards a dust trap. In a twelfth example of the method, optionally including one or more or each of the first through eleventh examples, the method further comprises, when the first rate of decay is greater than the first threshold and the second rate of decay is greater than the second threshold, confirming the FTIV is not restricted. In a thirteenth example of the method, optionally including one or more or each of the first through twelfth examples, the first rate of decay, the second rate of decay, and the pressure of the evaporative emissions control system are estimated based on an output of a pressure sensor located in the vent path and the output is normalized with respect to an amount of fuel in a fuel tank coupled to the evaporative emissions control system. In a fourteenth example of the method, optionally including one or more or each of the first through thirteenth examples, a pump and the pressure sensor are coupled within an evaporative leak check module (ELCM).

The disclosure also provides support for a method for diagnosing a carbon canister, comprising responsive to a first rate of decay of a pressure of an evaporative emissions control system being less than a first threshold rate of decay while evacuating a carbon canister to atmosphere, confirming a presence of a restriction in the carbon canister based on the first rate of decay, responsive to a second rate of decay of the pressure of the evaporative emissions control system being less than a second threshold rate of decay while evacuating the carbon canister to a fuel tank, identifying a source of restriction as an integrated filter or a canister bed of the carbon canister, or a fuel tank isolation valve (FTIV) based on the second rate of decay, and responsive to identification of the integrated filter as the source of restriction, regenerating the integrated filter by operating a pump in a direction to pull air flow across the integrated filter towards a dust trap. In a first example of the method, identifying the source of the restriction includes indicating a degree of restriction of the integrated filter, when the integrated filter is the source of the restriction, based on an initial pressure difference across the canister when a canister purge valve is commanded open, and estimating a remaining lifetime of the integrated filter in response to determination of a partial restriction of the integrated filter based on a rate of vacuum decay and a duration to stabilize canister pressure to an atmospheric pressure from a reference pressure. In a second example of the method, optionally including the first example, the method further comprises diagnosing the carbon canister during one or more of an engine off condition and a fuel vapor-free status of the carbon canister.

The disclosure also provides support for a system for a hybrid electric vehicle, comprising an emissions control system including a fuel vapor canister, a purge line coupling the canister to an engine via a purge valve, and a conduit coupling the canister to a fuel tank via a fuel tank isolation valve, an integrated filter arranged in the canister, a pump integrated within an evaporative leak check module (ELCM), the ELCM arranged within a vent line of the canister, a pressure sensor in the ELCM, a controller with instructions stored in non-transitory memory, that when executed during an engine off condition, cause the controller to: close each of the purge valve and the fuel tank isolation valve, diagnose a restriction of the canister based on a first rate of decay of a pressure of an evaporative emissions control system being less than a first threshold rate of decay during evacuation of the canister to atmosphere, and identify a source of restriction as an integrated filter or a canister bed of the carbon canister, or a fuel tank isolation valve (FTIV) based on a second rate of decay of a pressure of the evaporative emissions control system being less than a second threshold rate of decay, when evacuating the canister to the fuel tank. In a first example of the system, the controller is further configured with instructions stored in non-transitory memory, that when executed in response to diagnosing the restriction, cause the controller to: close the purge valve, close the fuel tank isolation valve, and regenerate the integrated filter by operating the pump for a duration to pull air flow across the integrated filter towards a dust trap.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

indicating restriction of an integrated canister filter of a fuel vapor canister responsive to;

during evacuation of the canister to atmosphere;

a first rate of decay of a pressure of an evaporative emissions control system to a first target pressure being less than a first threshold rate of decay, and during evacuation of the canister to a fuel tank;

a second rate of decay of the pressure of the evaporative emissions control system to a second target pressure being greater than a second threshold rate of decay.

2. The method of claim 1, further comprising, automatically regenerating the integrated filter when the integrated filter is determined to be fully restricted.

3. The method of claim 1, further comprising confirming a presence of a restriction in the evaporative emissions control system based on the first rate of decay and wherein confirming the presence of the restriction includes isolating a canister side of the evaporative emissions control system by closing a canister purge valve, closing a fuel tank isolation valve (FTIV), and evacuating a volume of air in the canister side by operating a pump located in a vent path of the canister.

4. The method of claim 3, further comprising, when a pressure of the canister side is equal to a target vacuum, opening the canister purge valve to vent the evaporative emissions control system to the atmosphere and monitoring the first rate of decay until the pressure of the canister side reaches the first target pressure and wherein the first target pressure is atmospheric pressure.

5. The method of claim 1, further comprising, when the first rate of decay is greater than the first threshold rate of decay, indicating the canister is not restricted and diagnosing a restriction source based on the second rate of decay.

6. The method of claim 1, further comprising, when the first rate of decay is less than the first threshold rate of decay, indicating restriction of the canister and diagnosing a restriction source based on the second rate of decay.

7. The method of claim 3, further comprising confirming a restriction source in the evaporative emissions control system based on the second rate of decay and wherein confirming the restriction source includes determining restriction at the canister filter or at a canister bed by isolating the canister side of the evaporative emissions control system and evacuating a volume of air in the canister side by operating a pump, and wherein the canister side of the evaporative emissions control system is isolated by closing the canister purge valve and closing the fuel tank isolation valve (FTIV).

8. The method of claim 7, further comprising, when the evaporative emissions control system pressure is equal to the target vacuum, venting the evaporative emissions control system to the fuel tank by opening the fuel tank isolation valve, and monitoring the second rate of decay until the pressure of the canister side equals the second target pressure and wherein the second target pressure is atmospheric pressure.

9. The method of claim 1, further comprising, when the first rate of decay is greater than the first threshold rate of decay and the second rate of decay is less than the second threshold rate of decay, indicating the FTIV is restricted by setting a diagnostic trouble code (DTC).

10. The method of claim 1, further comprising, when the first rate of decay is less than the first threshold rate of decay and the second rate of decay is less than the second threshold rate of decay, indicating the canister bed is restricted by setting a diagnostic trouble code (DTC).

11. The method of claim 1, further comprising, when the first rate of decay is less than the first threshold rate of decay and the second rate of decay is greater than the second threshold rate of decay, confirming restriction of the filter which includes one or more of determining partial or full restriction of the canister, estimating a remaining lifetime of the filter when the filter is partially restricted, and regenerating the filter when the filter is fully restricted.

12. The method of claim 2, wherein regenerating the filter includes opening the canister purge valve, closing the fuel tank isolation valve, and turning a pump on for a duration to pull air flow across the filter towards a dust trap.

13. The method of claim 1, further comprising, when the first rate of decay is greater than the first threshold and the second rate of decay is greater than the second threshold, confirming the FTIV is not restricted.

14. The method of claim 1, wherein the first rate of decay, the second rate of decay, and the pressure of the evaporative emissions control system are estimated based on an output of a pressure sensor located in the vent path and the output is normalized with respect to an amount of fuel in a fuel tank coupled to the evaporative emissions control system.

15. The method of claim 14, wherein a pump and the pressure sensor are coupled within an evaporative leak check module (ELCM).

16. A method for diagnosing a carbon canister, comprising:

responsive to a first rate of decay of a pressure of an evaporative emissions control system being less than a first threshold rate of decay while evacuating a carbon canister to atmosphere;

confirming a presence of a restriction in the carbon canister based on the first rate of decay;

responsive to a second rate of decay of the pressure of the evaporative emissions control system being less than a second threshold rate of decay while evacuating the carbon canister to a fuel tank;

identifying a source of restriction as an integrated filter or a canister bed of the carbon canister, or a fuel tank isolation valve (FTIV) based on the second rate of decay; and responsive to identification of the integrated filter as the source of restriction;

regenerating the integrated filter by operating a pump in a direction to pull air flow across the integrated filter towards a dust trap.

17. The method of claim 16, wherein identifying the source of the restriction includes indicating a degree of restriction of the integrated filter, when the integrated filter is the source of the restriction, based on an initial pressure difference across the canister when a canister purge valve is commanded open, and estimating a remaining lifetime of the integrated filter in response to determination of a partial restriction of the integrated filter based on a rate of vacuum decay and a duration to stabilize canister pressure to an atmospheric pressure from a reference pressure.

18. The method of claim 17, further comprising diagnosing the carbon canister during one or more of an engine off condition and a fuel vapor-free status of the carbon canister.

19. A system for a hybrid electric vehicle, comprising:

an emissions control system including a fuel vapor canister, a purge line coupling the canister to an engine via a purge valve, and a conduit coupling the canister to a fuel tank via a fuel tank isolation valve;

an integrated filter arranged in the canister;

a pump integrated within an evaporative leak check module (ELCM), the ELCM arranged within a vent line of the canister;

a pressure sensor in the ELCM;

a controller with instructions stored in non-transitory memory, that when executed during an engine off condition, cause the controller to:

close each of the purge valve and the fuel tank isolation valve;

diagnose a restriction of the canister based on a first rate of decay of a pressure of an evaporative emissions control system being less than a first threshold rate of decay during evacuation of the canister to atmosphere; and identify a source of restriction as an integrated filter or a canister bed of the carbon canister, or a fuel tank isolation valve (FTIV) based on a second rate of decay of a pressure of the evaporative emissions control system being less than a second threshold rate of decay, when evacuating the canister to the fuel tank.

20. The system of claim 19, wherein the controller is further configured with instructions stored in non-transitory memory, that when executed in response to diagnosing the restriction, cause the controller to:

close the purge valve, close the fuel tank isolation valve; and regenerate the integrated filter by operating the pump for a duration to pull air flow across the integrated filter towards a dust trap.

* * * * *